US009562307B2

(12) United States Patent
Conti et al.

(10) Patent No.: US 9,562,307 B2
(45) Date of Patent: Feb. 7, 2017

(54) METHOD AND MACHINE FOR KNITTING TUBULAR KNITTED ARTICLES

(71) Applicant: STAUBLI ITALIA S.P.A., Carate Brianza (IT)

(72) Inventors: Gianni Conti, Florence (IT); Massimo Venni, Florence (IT)

(73) Assignee: STAUBLI ITALIA S.P.A., Carate Brianza (MI) (IT)

( * ) Notice: Subject to any disclaimer, the term of this patent is extended or adjusted under 35 U.S.C. 154(b) by 0 days.

(21) Appl. No.: 14/773,870

(22) PCT Filed: Apr. 10, 2014

(86) PCT No.: PCT/EP2014/057248
§ 371 (c)(1),
(2) Date: Sep. 9, 2015

(87) PCT Pub. No.: WO2014/167047
PCT Pub. Date: Oct. 16, 2014

(65) Prior Publication Data

US 2016/0024695 A1 Jan. 28, 2016

(30) Foreign Application Priority Data

Apr. 12, 2013 (IT) ..... FI2013A0081

(51) Int. Cl.
*D04B 9/40* (2006.01)
*D04B 15/02* (2006.01)
(Continued)

(52) U.S. Cl.
CPC ..... *D04B 9/40* (2013.01); *D04B 1/108* (2013.01); *D04B 9/44* (2013.01); *D04B 15/02* (2013.01)

(58) Field of Classification Search
CPC ..... D04B 9/40; D04B 15/02; D04B 9/44; D04B 1/108
(Continued)

(56) References Cited

U.S. PATENT DOCUMENTS 5,551,260 A 9/1996 Frullini et al.
5,570,591 A * 11/1996 Frullini ..... D04B 9/56 66/148
(Continued)

FOREIGN PATENT DOCUMENTS

IT PI2007A000091 8/2007
WO 98/38367 A1 9/1998
(Continued)

*Primary Examiner* — Danny Worrell
(74) *Attorney, Agent, or Firm* — McGlew and Tuttle, P.C.

(57) ABSTRACT

The method provides for arranging a pick-up member for the tubular knitted article (M) coaxially with the needle cylinder, when knitting has been completed. The pick-up member (23) is provided with a plurality of pick-up hooks (25A, 25B) arranged according to a circular ring subdivided into two circular half-rings that can be overturned over each other. The tubular article is engaged by the pick-up hooks while the stitches of the last course of the knitted article are still held by the needles (5) of the knitting machine. The stitches of the last curse are then removed from the needles and the tubular article is removed from the needle cylinder (3) by means of the pick-up member (23). The two half-rings of pick-up hooks are overturned one onto the other, putting one of two opposite edges of the toe of the tubular article onto the other. The two edges are then sewn or linked.

32 Claims, 38 Drawing Sheets

(51) Int. Cl.
*D04B 9/44* (2006.01)
*D04B 1/10* (2006.01)

(58) Field of Classification Search
USPC ..... 66/148
See application file for complete search history.

(56) References Cited

U.S. PATENT DOCUMENTS

| | | | | | |
|---|---|---|---|---|---|
| 6,164,091 | A * | 12/2000 | Frullini | D04B 15/02 | 66/148 |
| 6,381,991 | B2 * | 5/2002 | Ando' | D04B 9/56 | 66/148 |
| 7,107,797 | B2 * | 9/2006 | Frullini | D04B 9/02 | 66/148 |
| 7,900,483 | B2 * | 3/2011 | Conti | D04B 9/40 | 66/148 |
| 8,443,633 | B1 * | 5/2013 | Inli | D04B 1/108 | 66/148 |
| 8,893,529 | B1 * | 11/2014 | Inli | D05B 23/009 | 66/148 |
| 2001/0039816 | A1 * | 11/2001 | Fujiwara | D04B 9/56 | 66/13 |
| 2003/0233852 | A1 * | 12/2003 | Lonati | D04B 9/10 | 66/17 |
| 2004/0168477 | A1 * | 9/2004 | Sangiacomo | D04B 15/02 | 66/8 |

FOREIGN PATENT DOCUMENTS

| | | | |
|---|---|---|---|
| WO | 2004/035894 | A1 | 4/2004 |
| WO | 2006/048138 | A1 | 5/2006 |
| WO | 2010/086708 | A1 | 8/2010 |

* cited by examiner

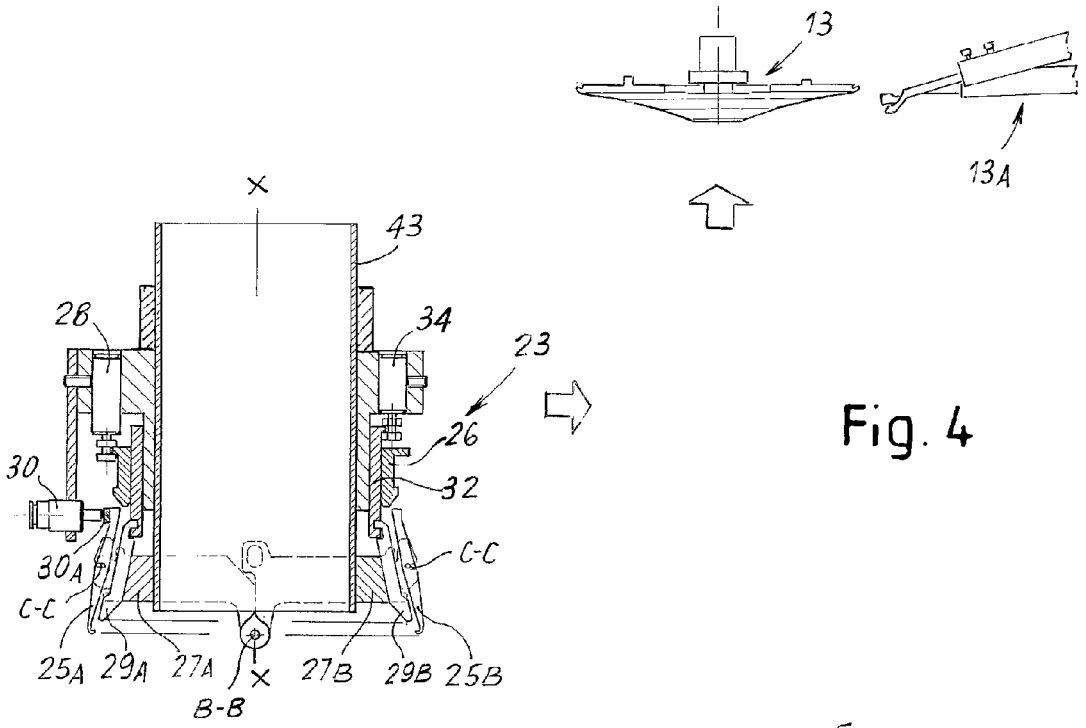
Fig. 4
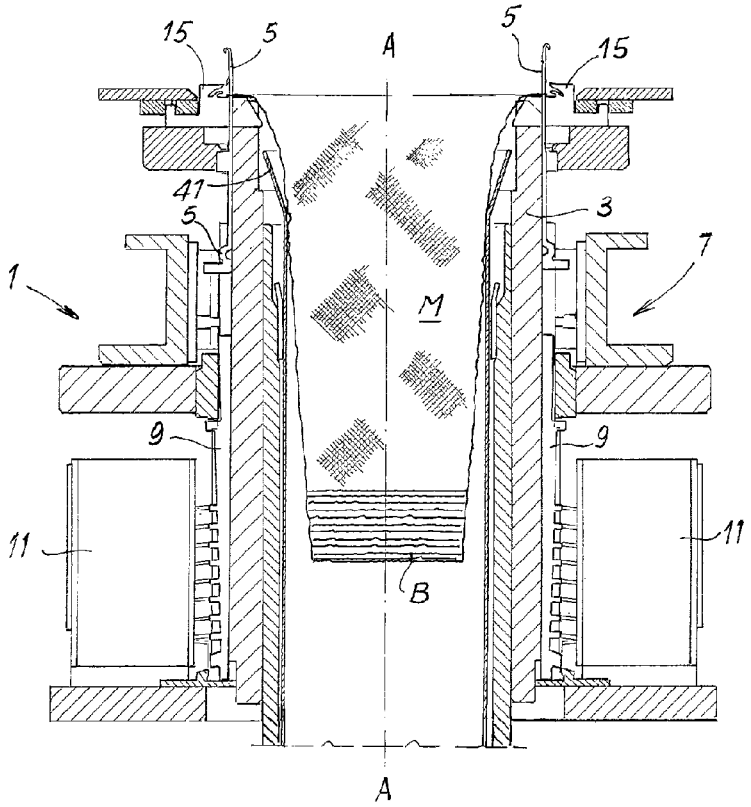

25A
5
15
3
A
43
28
34
23
32
26
25B
1
27A
27B
C-C
29B
30
30A
R
25A
29A
B-B
15
25x
5
5L
41
3
7
M
9
11
B

A
A
43
28
34
23
32
26
25B
C-C
1
29B
15
3
7
5
9
11
B
M
B-B
27A
27B
30
30A
C-C
25A
29A
25x
5L

A
43
28
34
23
29A
25A
M
32
26
30
25X
5
27A
27B
25B
30A
1
25A
29B
15
5L
29A
B-B
15
15
41
3
7
5
M
9
9
11
11
B
A

Fig.28
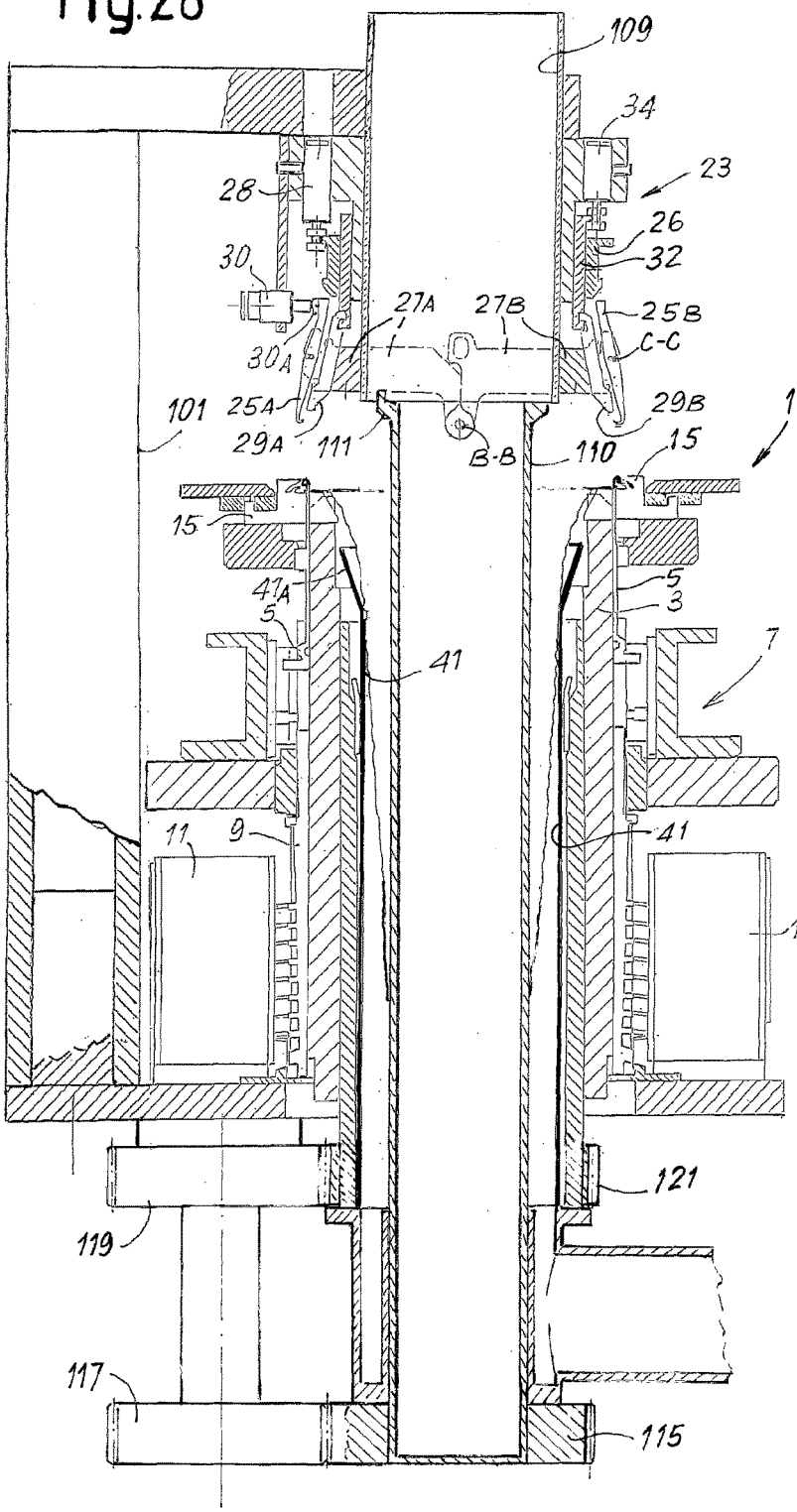
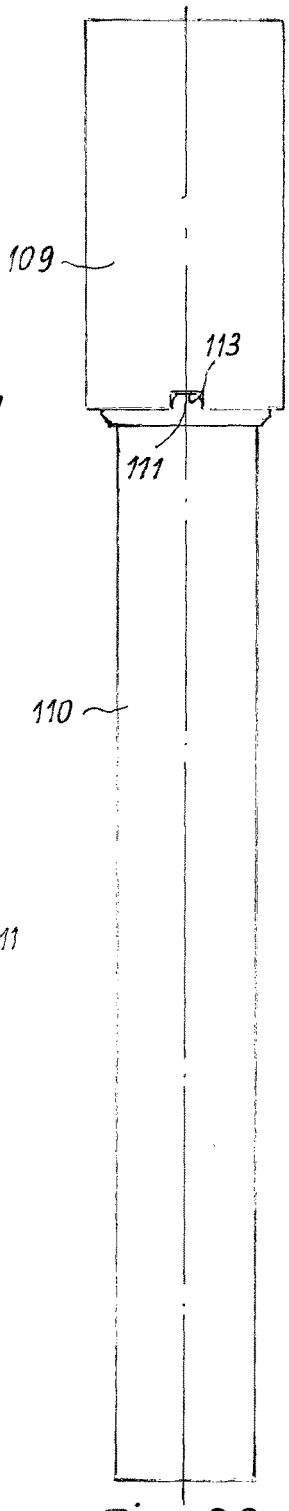
Fig. 29

43
28
34
23
26
32
30
27A
27B
C-C
C-C
25A
25B
29A
29B
B-B
1
5
5
XXXIV
XXXIV
15
15
41A
3
4
7
9
11
11
B

Fig. 36
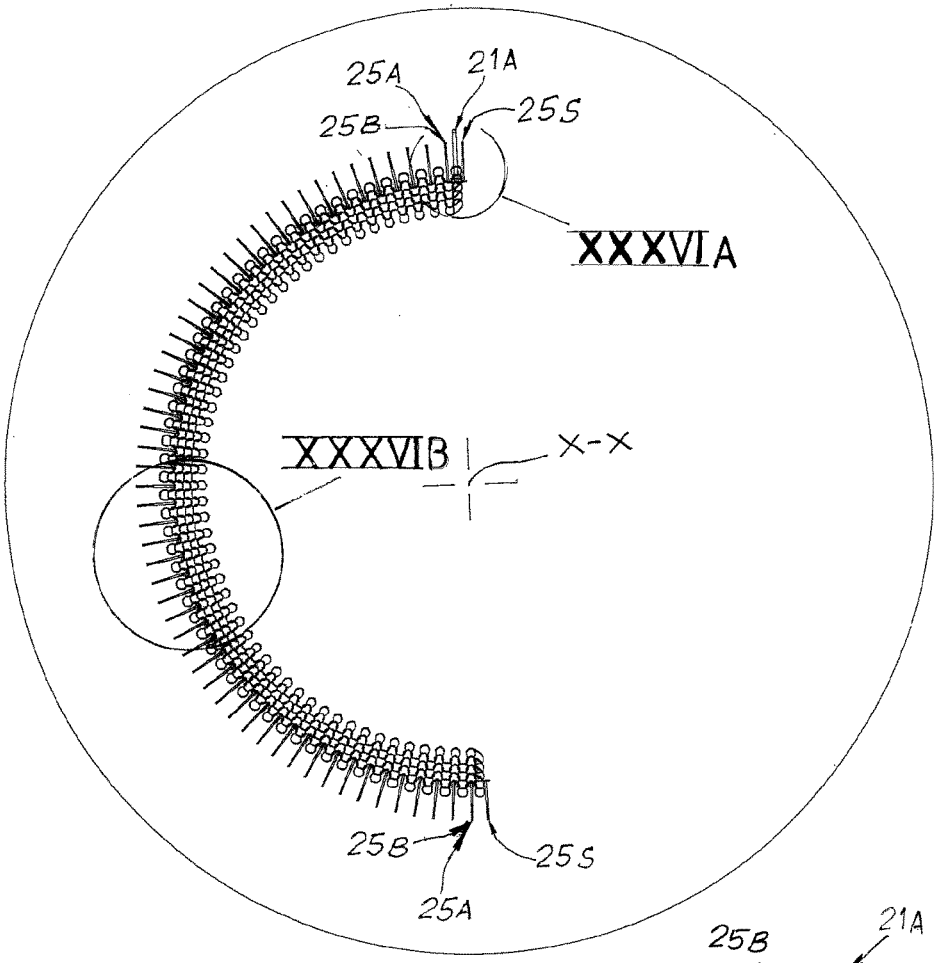
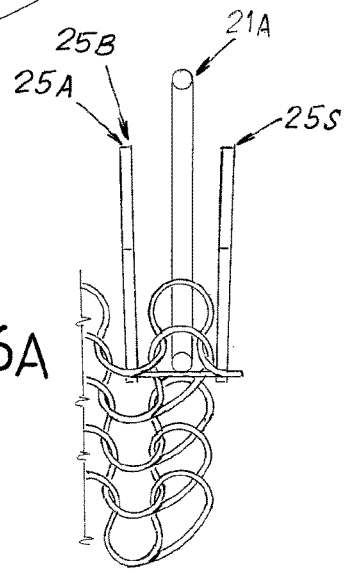
Fig. 36A

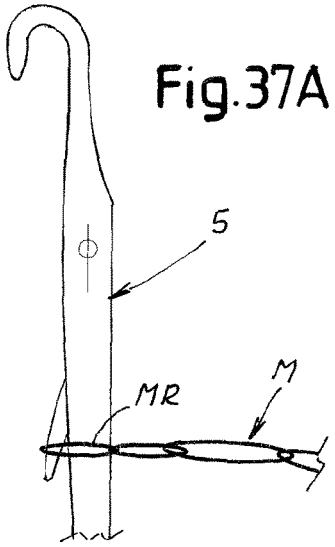
Fig.37A
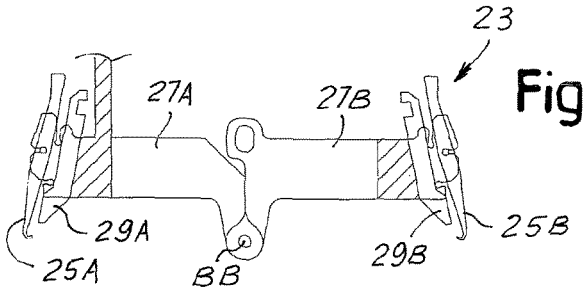
Fig.37
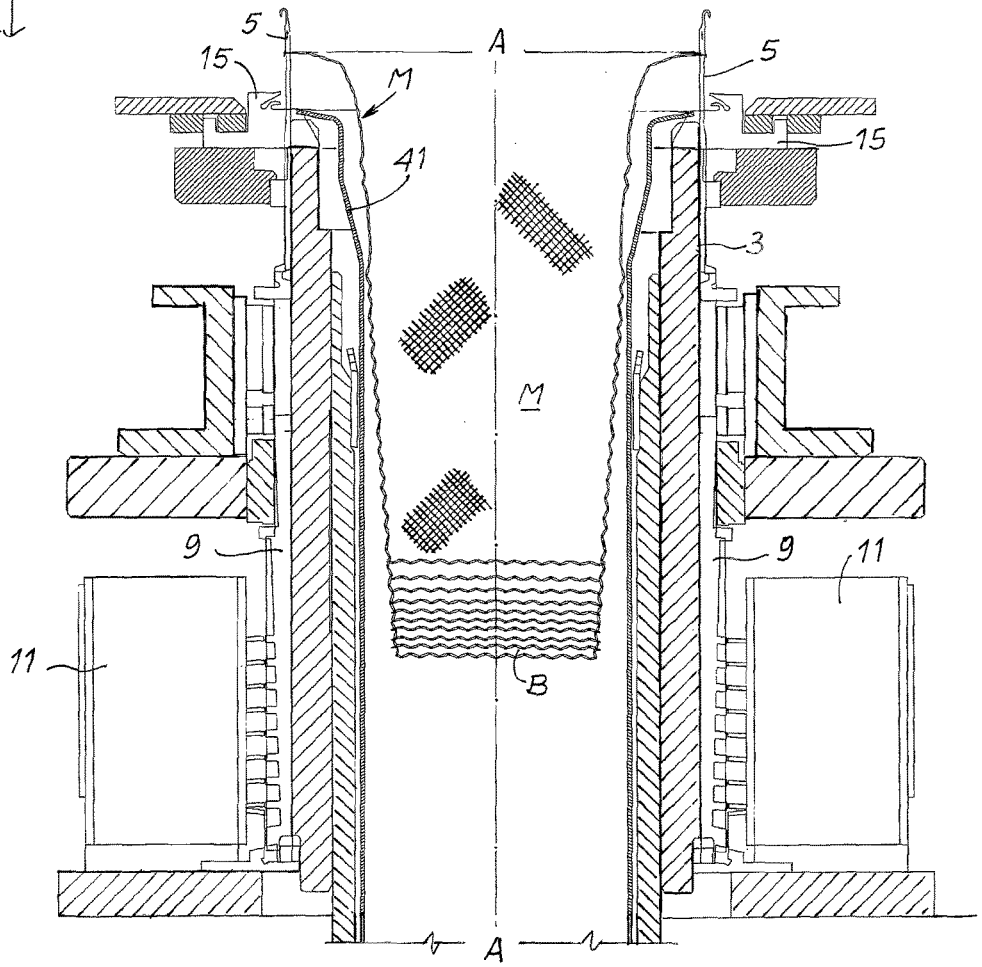

METHOD AND MACHINE FOR KNITTING TUBULAR KNITTED ARTICLES

TECHNICAL FIELD

The present invention relates to methods and machines for producing tubular knitted articles, such as socks and stockings.

STATE OF THE ART

For producing tubular articles, especially socks, circular knitting machines are used; these machines knit the article starting from an elastic border or edge up to an opposite end defining edge portions that, once sewn together, form the toe of the sock. In traditional machines, once the article has been knitted, the article is unloaded with the open toe, and the articles coming from one or more circular knitting machines are transferred to a sewing or linking machine or device. An operator picks up single articles, holding them at the toe end, and introduces them into the sewing machine or the linking machine to close the end of the toe. This traditional method is labor-consuming and therefore involves high production costs.

Devices and circular knitting machines have been studied to automatically pick up the tubular articles from the needle cylinder of a circular knitting machine and transfer the articles automatically to a sewing machine or to a linking outside of the knitting machine. WO2004/035894 discloses a device for automatically transferring and sewing the toe of a tubular article produced with a circular knitting machine.

WO2010/086708 describes a different, simpler and more efficient system for transferring the tubular article from the knitting machine to the sewing machine.

In these known systems, a pick-up member is provided for the tubular article comprising a plurality of pick-up hooks arranged according to a circular ring subdivided into two circular half-rings that can be overturned over each other. The pick-up member is arranged coaxially with the needle cylinder of the knitting machine, arranging the pick-up hooks so that they can receive the tubular article. In WO2004/035894 the pick-up member is such that each single stitch of the last course engaged by a respective needle of the needle cylinder is transferred onto a respective pick-up hook. It is therefore possible to link the tubular knitted article outside of the circular knitting machine. The article thus obtained has high quality but the linking process is complex and long-lasting; furthermore the device for pick the tubular article up is particularly complex and expensive.

The machine described in WO2010/086708 has a pick-up member with a plurality of fixed pick-up hooks. By lowering the pick-up member the pick-up hooks penetrate the knitted fabric while the last course of stitches of said tubular article is still engaged by the needles of the circular knitting machine. The pick-up movement of the pick-up hooks is provided by moving the pick-up member towards the loop formation plane with a movement parallel to the axis of the needle cylinder, so that the pick-up hooks penetrate through the fabric of the tubular knitted article. In a subsequent step, the stitches of the last course are removed from the needles and the tubular knitted article remains engaged to the pick-up hooks of the pick-up member. The pick-up member is lifted, removes the article from the needle cylinder and transfers it to a sewing machine outside the knitting machine.

The Italian patent application PI2007A000091 discloses a circular knitting machine with a pick-up member provided with a plurality of fixed pick-up hooks arranged according to a circular shape with smaller diameter than the diameter of the circular needle bed formed by the needles of the machine cylinder. The tubular article is transferred from the needle cylinder to the ring of pick-up hooks removing the last course from the needles so that, due to the elasticity of the yarn with which the last course has been formed, it contracts and engages with the pick-up hooks.

WO-A-2006/048138 discloses a system comprising a circular knitting machine for the production of hosiery knitted articles and an automatic sewing device combined thereto. A transfer mechanism is provided for picking up the knitted article from the circular needle bed of the knitting machine and transferring the article towards the sewing machine. The transfer mechanism comprises a plurality of circularly arranged blade pairs. The blade pairs are arranged for penetrating between adjacent needles of the knitting machine by means of a radial translation movement and pinching a relatively large portion of knitted fabric. The knitted article is then removed from the knitting machine. The blade pairs are arranged according to two semicircular arrangements, which can be turned one against the other. Once the two semicircular blade arrangements are turned one against the other with the open toe of the knitted article retained by the blades, the opposite edge of the knitted article is sucked in a suction tube and a pair of semicircular pressers engage the knitted article at a distance from the toe edge. A selvage is thus formed between the blades and the semicircular pressers. The blades then release the toe edge and the semicircular pressers move the knitted article towards a sewing machine. The sewing machine sews the toe and cuts the selvage beyond the sewing line. A very coarse and low-quality article of manufacture is obtained with this known device, which in addition generates a large amount of scraps. Scraps are undesired, since they increase the overall manufacturing costs and generate waste which must be disposed of.

All these systems have inconveniences due to the complexity of the devices for handling the tubular knitted article or due to a low reliability.

SUMMARY OF THE INVENTION

Disclosed herein is a new and more efficient method for manufacturing tubular knitted articles on circular knitting machines, picking up said tubular knitted articles from the circular needle bed of the knitting machine and transferring the tubular knitted articles to a closing machine or device, which closes the toe by joining opposite edge portions thereof, for instance a sewing machine or. preferably, a linking machine.

According to a further aspect, disclosed herein is an improved system including a circular knitting machine with new and more efficient devices for transferring the tubular knitted articles from the needle cylinder to the sewing machine.

According to one aspect, a knitting method is provided, wherein, at the end of knitting, the stitches of the last course are retained on the needles of the circular needle bed. In this condition, pick-up hooks are inserted between adjacent needles to engage loops of the tubular article in an intermediate position between consecutive needles. Once the pick-up hooks have achieved the right position, the stitches of the last course are removed from the needles and the article remains engaged by the pick-up hooks. Picking-up may be performed at the last or the penultimate course, or in general at courses before the last one. The pick-up hooks are advantageously inserted between adjacent needles of the circular needle bed of the cylinder of the circular knitting machine and engage the loops arranged between the last course of stitches still engaged by the needles. After the pick-up hooks have engaged the tubular article, the needles advantageously unload, i.e. release the stitches of the last knitted course or rank and the knitted tubular article may be transferred from the circular machine to the closing device, e.g. a sewing or linking machine.

At least one hook is preferably inserted between each pair of consecutive needles. In other embodiments two pick-up hooks are inserted between each pair of needles, a sinker being located between these two pick-up hooks.

In simplified embodiments the number of pick-up hooks may be however lower than the number of needles and the pick-up hooks are therefore inserted only between some of the pairs of consecutive needles, for instance one hook for each two pairs of needles.

According to one aspect, a method is disclosed for producing tubular knitted articles on a circular knitting machine comprising a needle cylinder with a circular needle bed for knitting the tubular articles, said method comprising the following steps:

- knitting a tubular knitted article starting from an elastic edge and ending with an open toe;
- arranging a pick-up member, for picking-up the tubular article, coaxially with the needle cylinder, said pick-up member being provided with a plurality of pick-up hooks arranged according to a circular ring subdivided into two circular half-rings that can be overturned over each other;
- engaging the tubular article by means of said plurality of pick-up hooks while the stitches of the last course of the knitted article are still held by said needles, one of said two circular half-rings engaging a first edge portion of an edge of the open toe and another of said two circular half-rings engaging a second edge portion of the edge of the open toe;
- once the tubular article has been engaged by the pick-up hooks, unloading the stitches of the last course from the needles;
- removing the tubular article from the needle cylinder by means of said pick-up member;
- overturning one of said two half-rings of pick-up hooks onto the other of said half-rings of pick-up hooks, placing one of said first and second edge portions onto the other of said first and second edge portions;
- while the tubular article is still engaged by the pick-up member, joining the first and second edge portions together thus forming a closed toe;
- after closing the toe by joining the first and second edge portions together, unloading the tubular article from the pick-up member.

In preferred embodiments, the method provides for inserting the pick-up hooks between pairs of consecutive needles of the needle cylinder. Active ends of the pick-up hooks can thus engage loops of the knitted article between pairs of consecutive needles of the needle bed.

In some embodiments, the method further comprises the steps of: arranging said pick-up hooks with pick-up active ends thereof around the needles of the circular knitting machine and outside thereof; and engaging the tubular article by moving said active ends radially inwardly towards the circular needle bed of the circular knitting machine for engaging the tubular article therewith.

According to a further aspect, a method is disclosed for producing tubular knitted articles on a circular knitting machine comprising a needle cylinder with a circular needle bed for knitting the tubular articles, said method comprising the following steps:

- providing a pick-up member, for picking-up the tubular article, the pick-up member being comprised of a plurality of pick-up hooks arranged according to a circular ring, each pick-up hook provided with a respective active end, the pick-up hooks pivotally connected to two semi-circular supports which are hinged to one another around an axis, thus forming a first half-ring and a second half ring of pick-up hooks;
- knitting a tubular article on the circular needle bed, starting from an elastic edge and ending with an open toe;
- arranging the pick-up member coaxially with the needle cylinder, with the active ends of the pick-up hooks arranged around the needles of the needle cylinder and outside thereof;
- while the stitches of the last course of the knitted article are still held by said needles, engaging the tubular article with the plurality of pick-up hooks by pivoting the active ends of the pick-up hooks towards the circular needle bed of the circular knitting machine, whereby one of the two circular half-rings engages a first edge portion of an edge of the open toe and another of said two circular half-rings engages a second edge portion of said edge of the open toe;
- once the tubular article has been engaged by the pick-up hooks, unloading the stitches of the last course from the needles;
- removing the tubular article from the needle cylinder by means of the pick-up member;
- overturning one of the two half-rings of pick-up hooks onto the other of the two half-rings of pick-up hooks, placing one of said first and second edge portions onto the other of said first and second edge portions;
- while the tubular article is engaged by the pick-up member, joining the first and second edge portions together, thus forming a closed toe;
- after closing the toe by joining the first and second edge portions together, unloading the tubular article from the pick-up member.

Since the pick-up hooks are not required to receive respective stitches directly from the needles of the needle bed, but rather engage loops of the knitted article between adjacent and consecutive needles, less stringent tolerances are required. Possible limited deformations of the needles and/or of the pick-up hooks do not prejudice the correct functionality of the device.

The opposite first and second edge portions of the toe can be joined by sewing. However, preferably the first and second edge portions of the open toe of the tubular knitted article are joined by linking. Linking differs from sewing in that in linking a closing stitch is formed at each pair of opposite stitches of the two edge portions, to join them. On the contrary, in sewing there is no correspondence between the stitches of the opposite first and second edge portions to join and the sewing stitches, thus obtaining a simpler process that however results in a less finished tubular article.

In some advantageous embodiments the pick-up hooks are positioned so that their active ends are around the needles of the circular knitting machine and outside them and they are brought into engagement with the tubular article by moving the active ends towards the circular needle bed of the circular knitting machine with a centripetal movement from the outside towards the axis of the needle cylinder.

In some embodiments the active ends of the pick-up hooks are provided with tips or spikes configured for engaging loops or stitches of the tubular knitted article. The spikes are oriented generally radially towards the axis of the pick-up member.

In some embodiments the pick-up hooks are arranged and configured so as to engage and retain sinker loops of one of the last-formed courses of stitches by means of said pick-up hooks. Linking of the toe edge portions can be performed by joining needle loops of one of the last-formed courses of stitches of the first edge portion to respective needle loops of the second edge portion between the pick-up hooks. In other embodiments, linking of the toe edge portions can be performed by joining sinker loops of one of the last-formed courses of stitches of the first edge portion to respective sinker loops of the second edge portion.

The step of joining the first and second edge portions can further comprise the steps of:

rotating the pick-up member;

while rotating the pick-up member, joining the first and second edge portions with linking stitches;

while forming the linking stitches, sequentially releasing the knitted article from the pick-up hooks of one of the two half-rings, while retaining the knitted article on the other of said two half-rings.

In some embodiments, after having arranged the pick-up member coaxially with the needle cylinder, the pick-up hooks are actuated so as to bring them from an inactive position, where they are near the tubular article, to an active position, where they are gripping the tubular article, by means of a hook actuator associated with the pick-up member. The movement can be a pivoting movement around respective hook-axes which can be arranged generally at 90° with respect to the axis of the pick-up member.

In some embodiments a step is provided for blocking the stitches engaged by the pick-up hooks by means of mechanical members, for instance in the form of closure latches, before the stitches of the last course are removed from the needles. In other embodiments the closure latches may be omitted and the stitches may engage in a reliable way to the pick-up hooks by forming the stitches at least in some of the last courses with an elastic yarn.

When closure latches are provided, these can be provided with a translation movement from an open position to a closed position. In some embodiments the closing movement of the closure latches can be generally parallel to the axis of the pick-up member.

In some embodiments each pick-up hook and the respective closure latch can be co-planar. This arrangement results in small cross-sectional dimension of the hook-latch arrangement, so that the pick-up member can be used on knitting machines of high fineness, i.e. provided with a large number of knitting needles arranged relatively close to one another. In other embodiments each pair of pick-up hook and respective closure latch can be arranged side-by-side. This results in a more cumbersome but simpler to manufacture arrangement.

To make it easier for the pick-up hooks to pick the article up along the circular needle bed, in some embodiments the method may provide a step of raising or lifting the tubular article from a loop formation plane. Raising or lifting the article can be for instance by acting on the sinkers of the circular knitting machine. Alternatively, the tubular article can be lifted using an inner tube substantially coaxial with the needle cylinder. The tube is raised when knitting of the tubular article has been completed. The needles may be suitably extracted from the needle cylinder, i.e. raised, so that the stitches slide along the stems of the needles until they move beyond the needle latches. In this way it is possible, in a subsequent operating step, to unload the stitches by moving the needles back towards inside the tracks provided in the needle cylinder.

In other embodiments the article is raised from the loop formation plane by raising the needles. The needle latches provide an obstacle sufficient to prevent the tubular article from remaining in a low position in this rising step. I.e. the tubular article is moved upwards thanks to the interaction between the stitches of the last course and the needle stems, and especially between the stitches and the needle latches. In this way there is no need for an auxiliary mechanism for raising or lifting the last knitted stitches.

Depending upon the method used for raising the knitted article, a knitting machine may be provided comprising sinkers associated with the needles of the circular bed and members for controlling said sinkers, moving them so as to raise the stitches from the loop formation plane. In other embodiments, the knitting machine may comprise a tubular member coaxial with the needle cylinder and arranged inside thereof, provided with a raising and lowering movement parallel to the axis of the needle cylinder. In some embodiments the tubular member comprises a flared upper edge provided with grooves for the passage of sinkers of the needle cylinder during raising of the tubular member.

The tubular article is engaged by the pick-up hooks in correspondence of one or more courses, for instance in correspondence of the penultimate course and/or other previously knitted courses, for instance in correspondence of the penultimate and/or the third last course or even the fourth last course. In some embodiments the pick-up hooks may be designed to engage the yarn in correspondence of each pair of adjacent stitches of the penultimate course of stitches formed by the needles of the cylinder. More specifically, the pick-up hooks can engage the sinker loops formed in the last stitch courses of stitches or in the second last or third last course of stitches. With such a configuration it is possible to transfer the knitted article by means of the pick-up hooks and to overturn one half-ring of pick-up hooks on the other half-ring of pick-up hooks and linking the two opposite edge portions.

In other embodiments the method comprises the steps of:

raising the needles engaging the stitches of the last course;

lowering the needles and unloading the stitches of the last formed course, after having engaged the tubular article by means of said pick-up hooks.

The needles may be raised before, whilst or after the tubular article has been engaged by the pick-up hooks.

According to advantageous embodiments, the method of the present disclosure provides for producing at least one run-proof course before starting to remove the tubular article from the circular needle bed. This makes the engagement of the article by means of the pick-up hooks at one or more courses before the last one easier and safer.

In some embodiments, thanks to the novel method disclosed herein, there is no need for single pick-up elements, each of which co-acts with the corresponding needle of the cylinder, to remove the single stitches of the last course from the needles. It is therefore possible to handle the finished tubular article in a simpler and more reliable way, and to have a more robust machine, less subject to malfunctions or damages, without fragile and critical pick-up members typical of the known devices.

After the tubular article has been removed from the needle cylinder, it is advantageously turned inside out before overturning the two half-rings of the pick-up member one over the other.

According to a different aspect, the invention relates to a circular knitting machine comprising a needle cylinder comprised of a circular needle bed for producing knitted tubular articles, and further comprising a pick-up member for picking up and removing the knitted tubular articles from the needle bed and transfer the tubular article to a sewing or linking device. The pick-up member comprises a circular ring of pick-up hooks subdivided into two half-rings that can be overturned over each other. The knitting machine is advantageously controlled so that, when knitting has been completed, the pick-up member engages a tubular article by means of the pick-up hooks when the stitches of the last course of said tubular article are still engaged to the needles of the needles cylinder.

According to a further aspect, a system is provided, comprising:

- a circular knitting machine comprised of a needle cylinder with a plurality of needles forming a circular needle bed;
- a pick-up member for engaging and removing a knitted tubular article from the circular needle bed, said pick-up member comprising a circular ring of pick-up hooks, subdivided into two half-rings that are provided with an overturning movement, for overturning the two half rings one over the other;
- a closing device, configured and arranged for co-acting with said pick-up member for closing a toe of the knitted article while the knitting article is retained on the pick-up member;

wherein said knitting machine and said pick-up member are configured and controlled so that said pick-up member engages a final edge surrounding the open toe of a tubular article knitted by said knitting machine, by means of said pick-up hooks, when the stitches of the last course of said tubular article are still engaged by the needles of the needle cylinder, said pick-up hooks being configured for insertion between adjacent needles of the needle cylinder; and wherein said closing device and said pick-up member are configured and controlled so that the closing device joins opposed edge portions of the final edge of the knitted article retained by the half-rings of pick-up hooks, the half-rings being overturned one over the other.

According to a further aspect, a system is provided, comprising:

- a circular knitting machine comprised of a needle cylinder with a plurality of needles forming a circular needle bed;
- a pick-up member for engaging and removing a knitted tubular article from the needle bed, said pick-up member comprising a circular ring of pick-up hooks, subdivided into a first and a second half-rings, each pick-up hook of a one of said first and second half-rings being pivoted to a first semi-circular support and each pick-up hook of another of said first and second half-rings being pivoted to a second semi-circular support, the first and second semi-circular supports being hinged to one another such that the first and second half-rings can be arranged coplanar and can be overturned over one another;
- a closing device, configured and arranged for co-acting with the pick-up member for closing a toe of the knitted article while the knitting article is retained on the pick-up member;

wherein the knitting machine and the pick-up member are configured and controlled so that the pick-up member engages a final edge surrounding the open toe of a tubular article knitted by said knitting machine, by means of the pick-up hooks, when the stitches of the last course of the tubular article are still engaged by the needles of the circular needle bed; wherein the pick-up hooks are configured for insertion between adjacent needles of the needle bed; and wherein the closing device and the pick-up member are configured and controlled so that the closing device joins opposed edge portions of the final edge of the knitted article retained by the pick-up hooks, with first and second half-rings overturned one over the other.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood by means of the description below and the attached drawing, which shows practical embodiments of the invention. More in particular, in the drawing:

FIGS. 4 to 11 show vertical sections of the circular knitting machine in different steps during the transfer of the tubular article outside the machine;

FIGS. 6A and 7A show an enlargement of a pick-up hook cooperating with the knitting members (needles and sinkers) in the steps corresponding to FIGS. 6 and 7;

FIG. 7B shows an enlargement of a plan view of a portion of the needle cylinder in the working step corresponding to FIG. 7;

FIGS. 8, 8A, 8B show a vertical section of the needle cylinder and respective enlargements of a pick-up hook cooperating with the knitting members (needles and sinkers) while engaging the article and removing the stitches from the needles cylinder;

FIG. 9 shows a view similar to that of FIG. 8 after the needles have been lowered and the stitches of the last course have been unloaded;

FIG. 9A shows an enlargement of a hook and a needle in the step of FIG. 9;

FIGS. 10 and 11 show subsequent steps of the removal of the tubular knitted article from the needle cylinder of the circular knitting machine;

FIG. 28 shows a vertical section of the circular knitting machine and the pick-up member in a modified embodiment;

FIG. 29 shows a side view of the suction tube of the machine of FIG. 28 engaged to the pick-up member;

FIG. 36 shows a view similar to that of FIG. 35, after the half-rings of pick-up hooks 25A, 25B have been overturned one over the other by 180°;

FIG. 36A shows an enlargement of a portion of FIG. 36, corresponding to the axis of overturning of the two half-rings of pick-up hooks;

FIGS. 37 and 38 show views similar to those of FIGS. 26, 27 in a different embodiment; and FIG. 37A shows an enlargement of a needle in the position of FIG. 37;

FIG. 38 shows a section along a plane containing axis of the circular arrangement or crown of pick-up hooks 25A, 25B during the sewing or linking operation;

DETAILED DESCRIPTION OF AN EMBODIMENT

Figure 3:
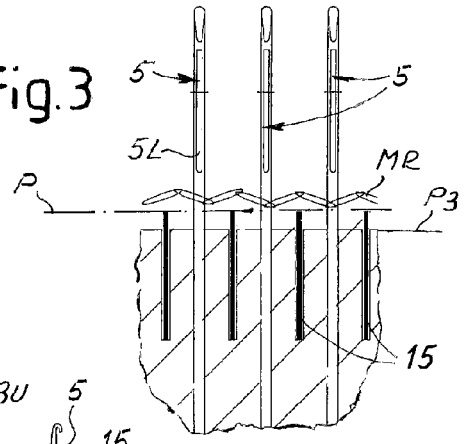
FIG. 3 shows an enlargement of a portion of FIG. 2, showing the needles, the sinkers and the loop formation plane.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Here below the embodiment illustrated in FIGS. 1 to 24 will be described first.

The circular knitting machine, indicated as a whole with number 1, has a needle cylinder 3 with a plurality of tracks for needles 5 forming a circular needle bed. Control cams for the needles are indicated with number 7, jacks are indicated with number 9 and actuators with number 11. All these knitting members are well known and will be not described in greater detail. The rotation axis of the needle cylinder 3 is indicated with A-A. In the illustrated embodiment, while knitting the tubular knitted article M the circular bed of needles 5 cooperates with a dial 13 positioned above, and coaxially with, the needle cylinder and provided with pick-up hooks 13U controlled by corresponding cams, not shown. Number 15 indicates the sinkers associated with the needle cylinder 3, cooperating with the needles 5 and inserted between them.

Figure 1:
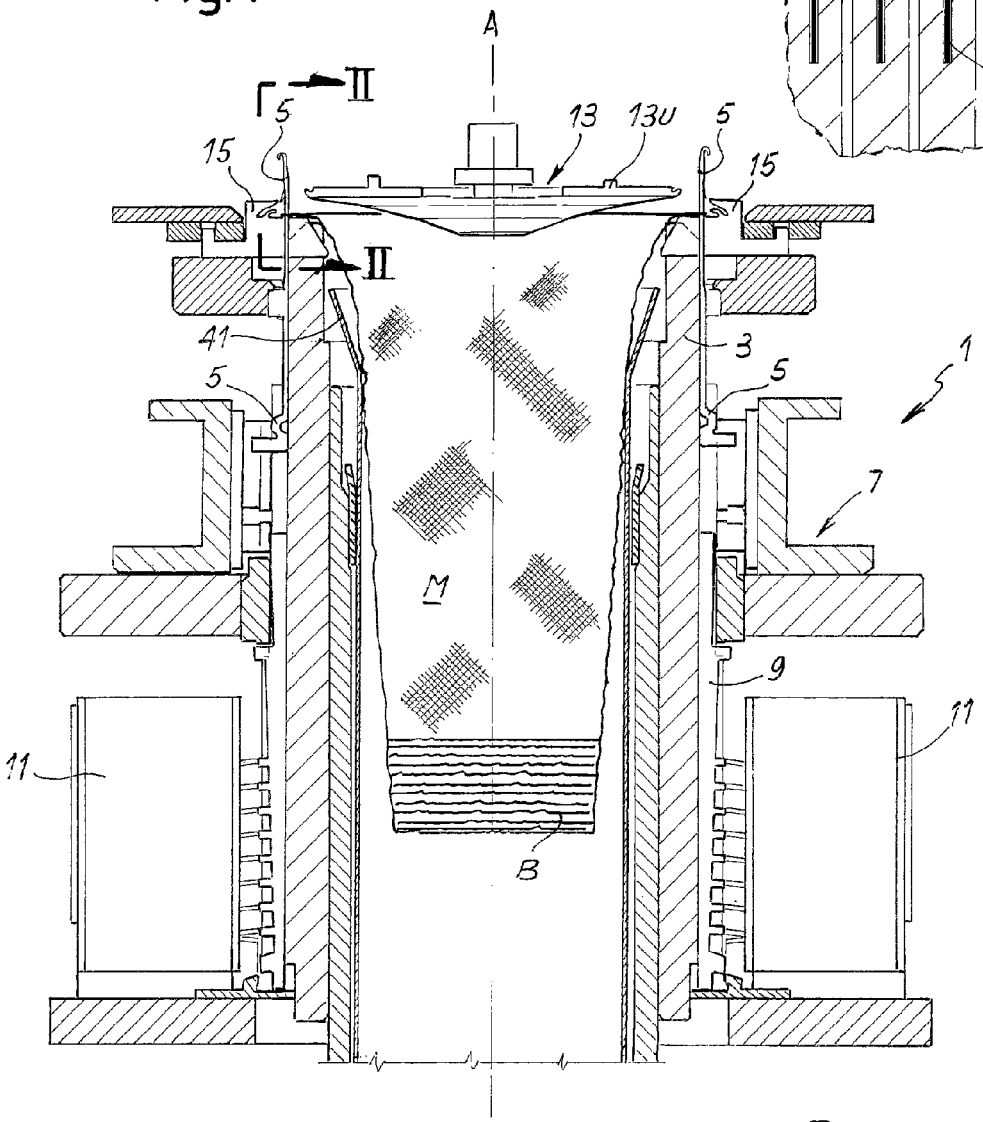
FIG. 1 shows a vertical section of a circular knitting machine while knitting a tubular knitted article.

Knitting of the tubular knitted article M starts with the formation of the elastic edge B and ends with the formation of the last course of stitches. In FIG. 1 the last course of stitches, indicated with MR in FIG. 3, is engaged to the needles 5. The last course, and if necessary the courses formed immediately before the last one, for instance, the penultimate, the third last and the fourth last course, form the final edge of the tubular knitted article M, said final edge forming an open toe of the tubular knitted article. The open toe shall be sewn or linked to form the closed toe of the tubular knitted article M. In some embodiments one or more final courses, for instance the last 3-10 courses, may be knitted with an elastic thread, for instance Lycra®.

The toe of the tubular knitted article M is closed by means of a sewing machine or a linking machine, outside of the circular knitting machine 1, to which the tubular article M is transferred in the way described below.

Figure 2:
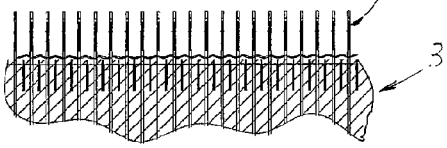
FIG. 2 shows a plan view of a portion of the circular needle bed of the knitting machine of FIG. 1.

FIG. 2 shows a plan view of a portion of the circular bed of needles 5, as seen from the inside of the needle cylinder 3 according to the line II-II of FIG. 1 and developed on a plane. FIG. 3 shows an enlarged section of a portion of the bed of needles 5 developed on a plane and in a view from the outside of the needle cylinder 3. In the enlargement of FIG. 3, three needles 5 are shown in raised position, engaging the last course MR of the tubular article M above the loop formation plane indicated with P. Also the corresponding sinkers 15 are shown in FIG. 3.

A pick-up member, indicated as a whole with number 23 (FIG. 4 and following), is provided to transfer the knitted tubular article M from the circular knitting machine 1 to a closing device, e.g. a sewing or linking machine, that is outside of the circular knitting machine 1 and is indicated with 21 in FIGS. 17-24. The pick-up member 23 comprises a ring of pick-up hooks 25A, 25B. The pick-up hooks 25A, 25B can be pivotally connected to two semi-circular supports 27A, 27B hinged around a substantially horizontal axis B-B. In this way two half-rings of pick-up hooks 25A, 25B are formed, which can be arranged coplanar to form a circular ring of pick-up hooks 25A, 25B and which can be overturned over one another so as to bring the pick-up hooks 25B facing the pick-up hooks 25A.

The two half-rings of pick-up hooks 25A, 25B are configured to engage a first and a second edge portion of the final edge of the tubular knitted article, so that when the two half-rings are turned one over the other in a face-to-face relationship, the two opposite first and second portions of the final edge of the tubular knitted article M are brought one towards the other facing each other to sew or link them, as described in greater detail below. Each hook 25A, 25B has an active end to engage the tubular knitted article M near or in correspondence of the last course of stitches. In the illustrated example the active end of each pick-up hook (see in particular FIGS. 6A, 7A) is provided with a tip or spike 25X arranged for hooking the knitted fabric. The tips or spikes 25X are oriented generally radially towards the axis X-X of the pick-up member 23.

A portion of each pick-up hook 25A, 25B, e.g. the end thereof opposite to the active end, is designed to cooperate with control members for controlling the pivoting or rotation movement of the pick-up hooks, to engage the tubular knitted article M and release said tubular knitted article M after the toe has been sewn or linked, as will be better explained in the following detailed description.

In this embodiment, a closure latch 29A, 29B is associated with each pick-up hook 25A, 25B. Each closure latch can be controlled, in a way described below, to engage to the respective hook a corresponding stitch or loop of the tubular knitted article M to be transferred to the sewing or linking machine 21.

In some embodiments, the closure latches are controlled so as to move according to a translation direction generally parallel to an axis X-X of the pick-up member 23.

Figures 7, 7A, 7B:
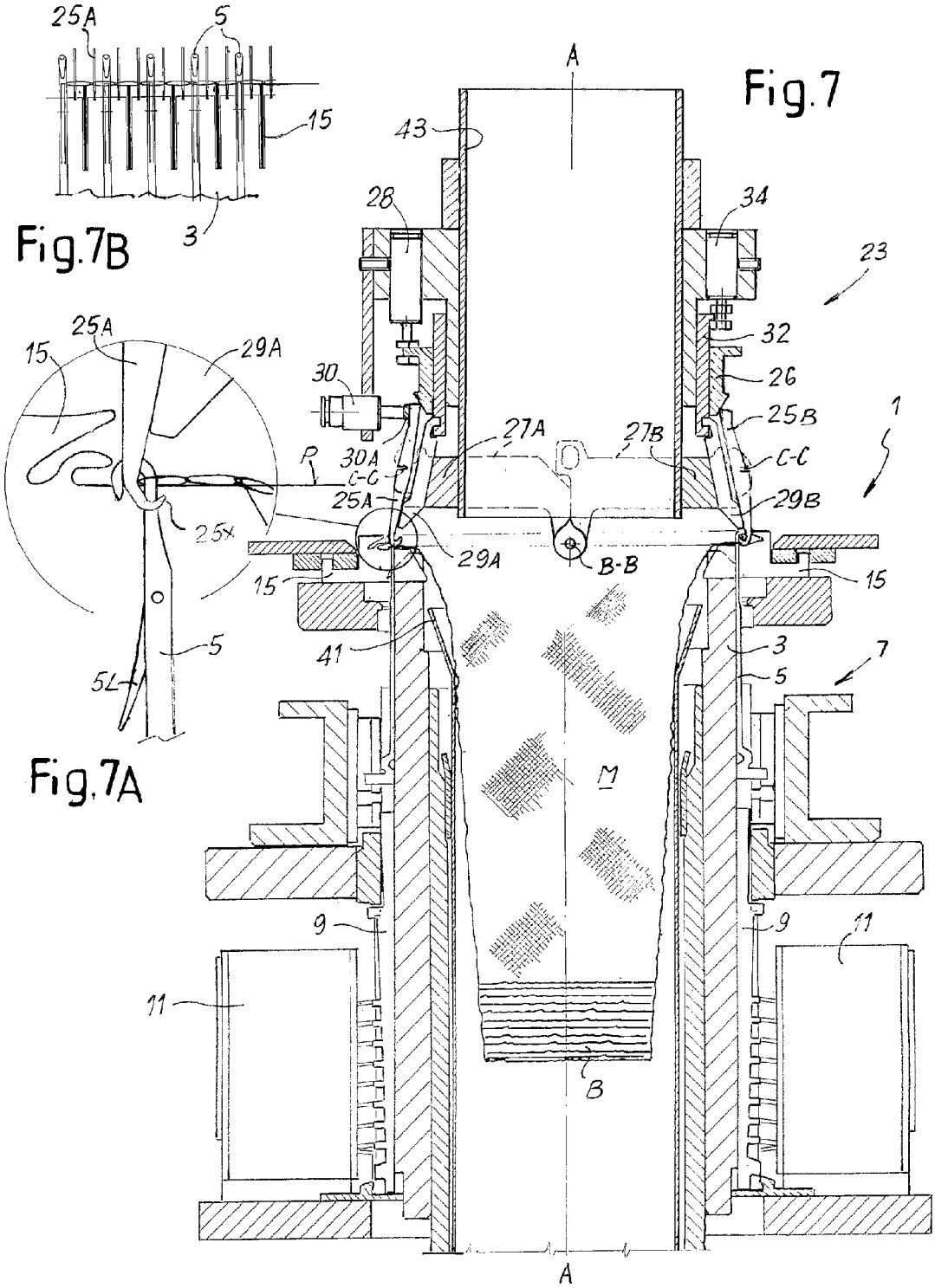

According to some embodiments each pick-up hook 25A, 25B is arranged co-planar with the corresponding closure latch 29A, 29B, as can be best appreciated e.g. in FIG. 7A. The total thickness of a pair of pick-up hook 25A, 25B and corresponding closure latch 29A, 29B is thus equal the thickness of the thicker one of said components. A co-planar arrangement of pick-up hook and relevant closure latch is particularly advantageous in case of high fineness knitting machines.

The operation of the knitting machine and the pick-up member described above will be better understood with reference to the sequence described below with reference to FIGS. 1 to 24.

Figure 5:
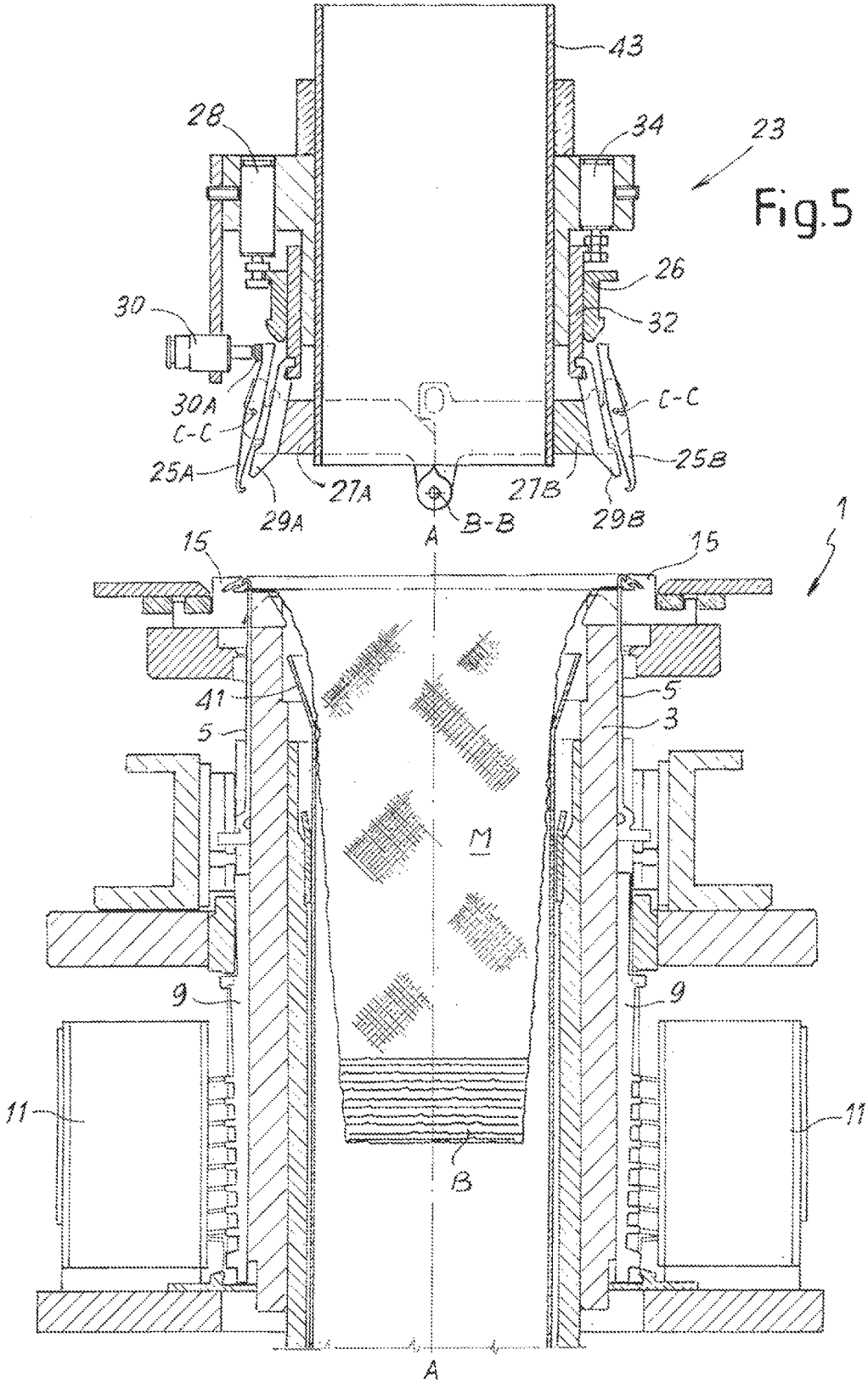

In FIG. 1, the tubular knitted article M has been completed and the last course of stitches MR is engaged to the circular needle bed 5 of the needle cylinder 3. The dial 13 and the yarn guides (one of which s schematically indicated with 13A in FIG. 4) are then raised from the circular bed of needles 5 to make space for the pick-up member 23. In FIG. 4 the dial has been raised and moved away from the circular bed of needles 5, and the pick-up member can move towards the needle cylinder 3, firstly taking a position above the needle cylinder 3 and coaxial therewith (i.e. the axis X-X of the pick-up member 23 is coincident with the axis A-A of the needle cylinder 3), and then moving downwards, approaching the needle cylinder 3. The needles 5 are in raised position, retaining the stitches of the last course MR. In FIG. 5 the pick-up member 23 is in coaxial position above the cylinder 3 of the needles 5, in the space made available by the dial 13 that has been raised. In this step the needles 5 may have been lowered, but not to an extent sufficient to unload the stitches.

Figure 6A:
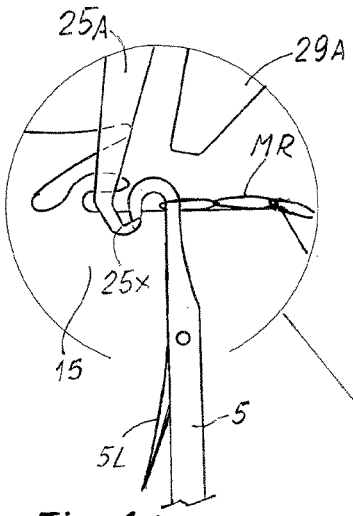
Figure 6:
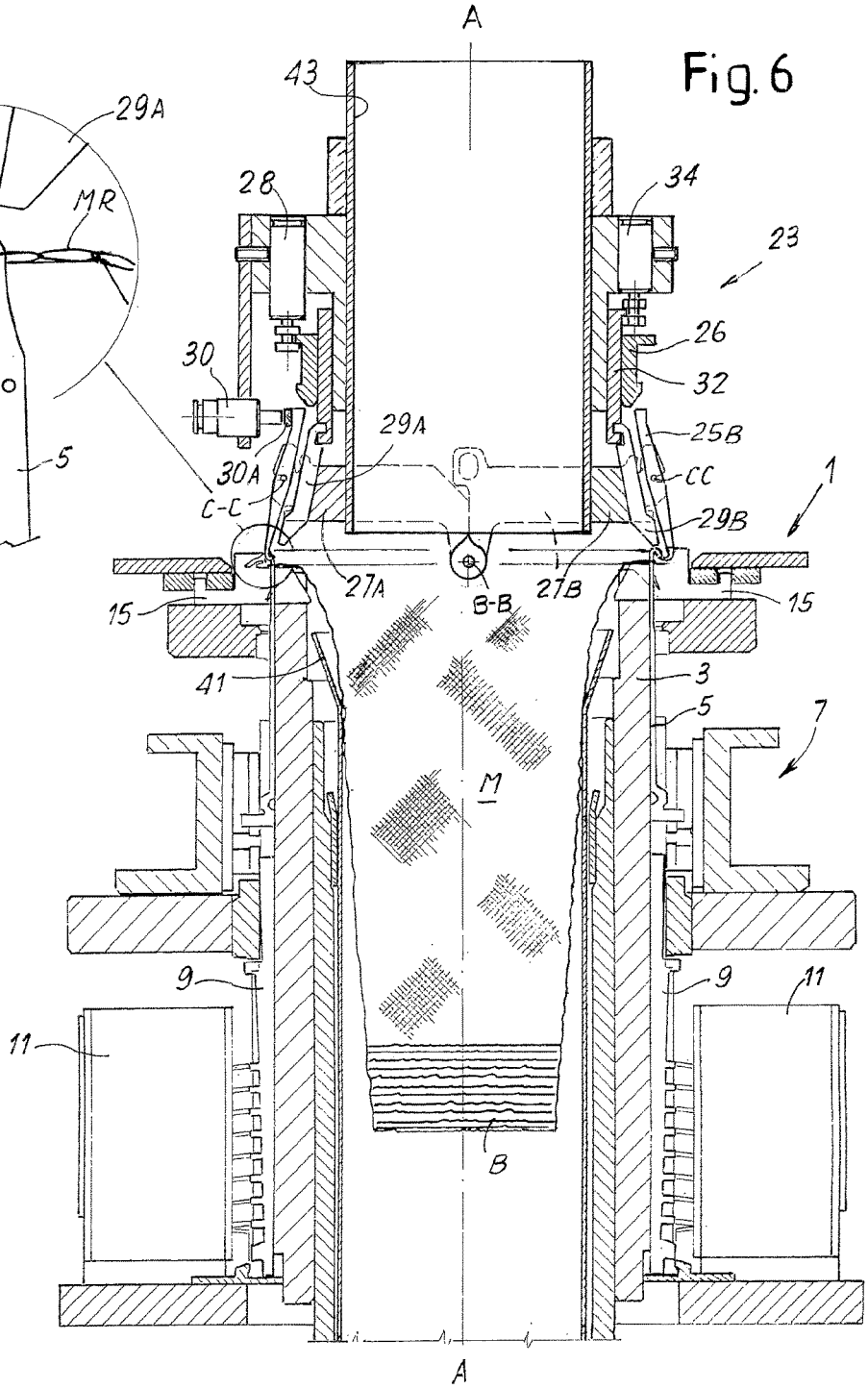

In FIG. 6 the pick-up member 23 has been lowered and the pick-up hooks 25A, 25B are arranged outside of the circular bed of needles 5. In this step the closure latches 29A, 29B are open and the pick-up hooks 25A, 25B are in spread position, i.e. the ends thereof are distanced from the axis A-A of the cylinder 3 of the needles 5. In this embodiment, to engage the stitches of the second to last course formed on the circular knitting machine 1 the pick-up hooks 25A, 25B are rotated, i.e. pivoted around respective horizontal pivoting axes C-C so that their active ends provided with spikes 25X perform a radially inward movement towards the axis A-A of the cylinder 3 of the needles 5. This movement can be appreciated by comparing FIGS. 6A and 7A. In FIG. 6A the pick-up hooks 25A, 25B are still spaced with respect to the last course MR of stitches of the tubular knitted article M engaged by the needles 5, while in FIG. 7A the pick-up hooks are positioned, with respect to the axis A-A of the cylinder 3 of the needles 5, nearly at the same distance as the stems of the needles 5, below the loop formation plane and the last course MR of the tubular knitted article M. The pivoting movement of the pick-up hooks 25A, 25B is controlled for instance by means of an annular cam 26 having a front profile and controlled by an actuator 28, both carried by the pick-up member 23.

In some embodiments a pair of pick-up hooks 25A, 25B are provided for each needle 5, as shown in detail in FIG. 7B. In other embodiments a different number of pick-up hooks 25A, 25B may be provided, for instance only one hook for each needle 5.

According to some embodiments, the pivoting axes C-C are arranged above the needles 5 such that engagement of the tubular knitted article M is performed by pivoting each individual hook 25A, 25B radially inwardly from a position around and outside the needle bed towards a position where each hook 25A, 25B projects with the hooked end thereof between the needles towards the axis A-A of the needle cylinder 3.

A smaller number of pick-up hooks may be also provided, so that in at least some points of the circular extension of the needle bed there are pairs of consecutive needles without pick-up hooks inserted between them. However, at least one hook for each pair of consecutive, i.e. adjacent, needles 5 is preferably provided in the circular bed.

In general, independently of the number of pick-up hooks provided for each needle, according to some advantageous embodiments, the pick-up hooks are inserted between adjacent needles to engage the fabric near or in correspondence of the last formed course, at intermediate positions between consecutive needles.

Figures 8, 8A, 8B:
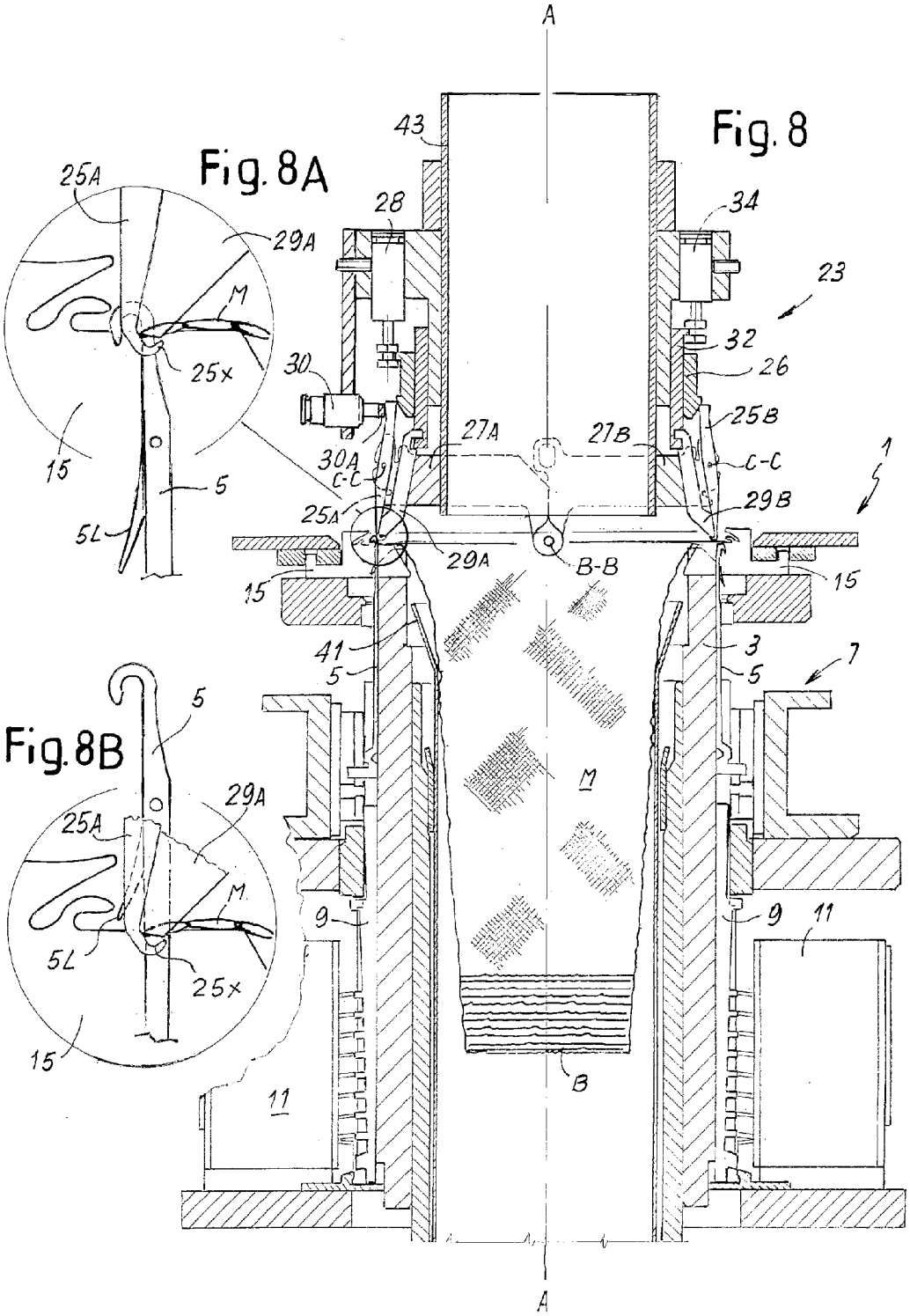
Figures 9, 9A:
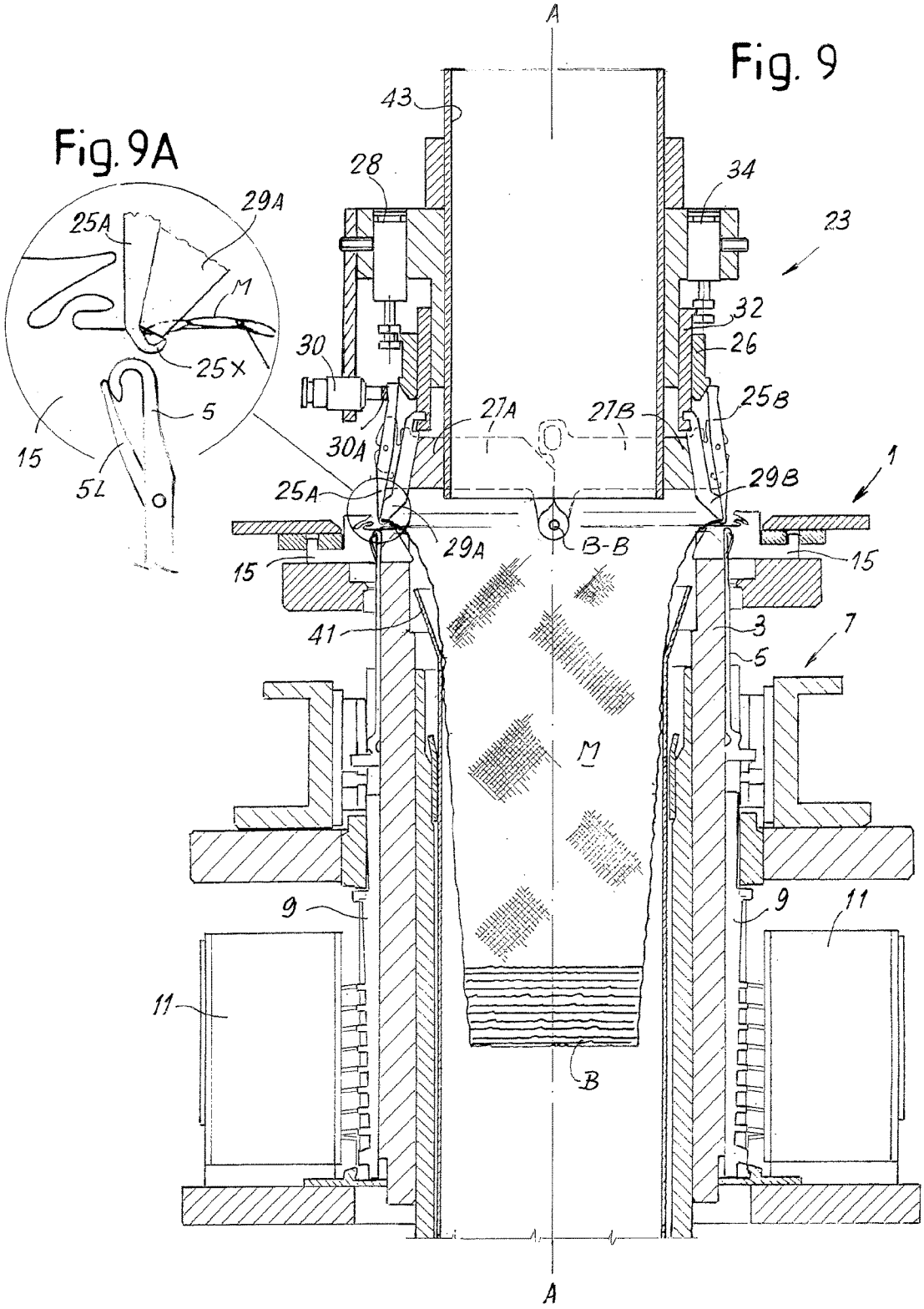

In FIGS. 8 and 8A the closure latches 29A, 29B are closed by means of a further annular channel cam 32 controlled by an actuator 34 of the pick-up member 23, to hold the stitches engaged by the pick-up hooks 25A, 25B. In some embodiments, the closing movement of the closure latch is a translation movement. The translation movement can be generally parallel to axis X-X of the pick-up member 23, i.e. generally parallel to the axis A-A of the needle cylinder 3, which in this phase of the process is co-axial to the pick-up member 23. The last stitches are then unloaded from the needles 5 (see FIGS. 8B, 9, 9A). To this end the needles 5 are raised (FIG. 8B) until their respective needle latches 5L are above the stitches. The needles 5 are then lowered (FIG. 9A) below the loop formation plane P, causing the stitches of the last course to be removed. In this way the article M remains engaged to the ring of pick-up hooks 25A, 25B and held by means of the closure latches 29A, 29B in closed arrangement in intermediate positions between the last stitches removed from the needles 5.

Figure 10:
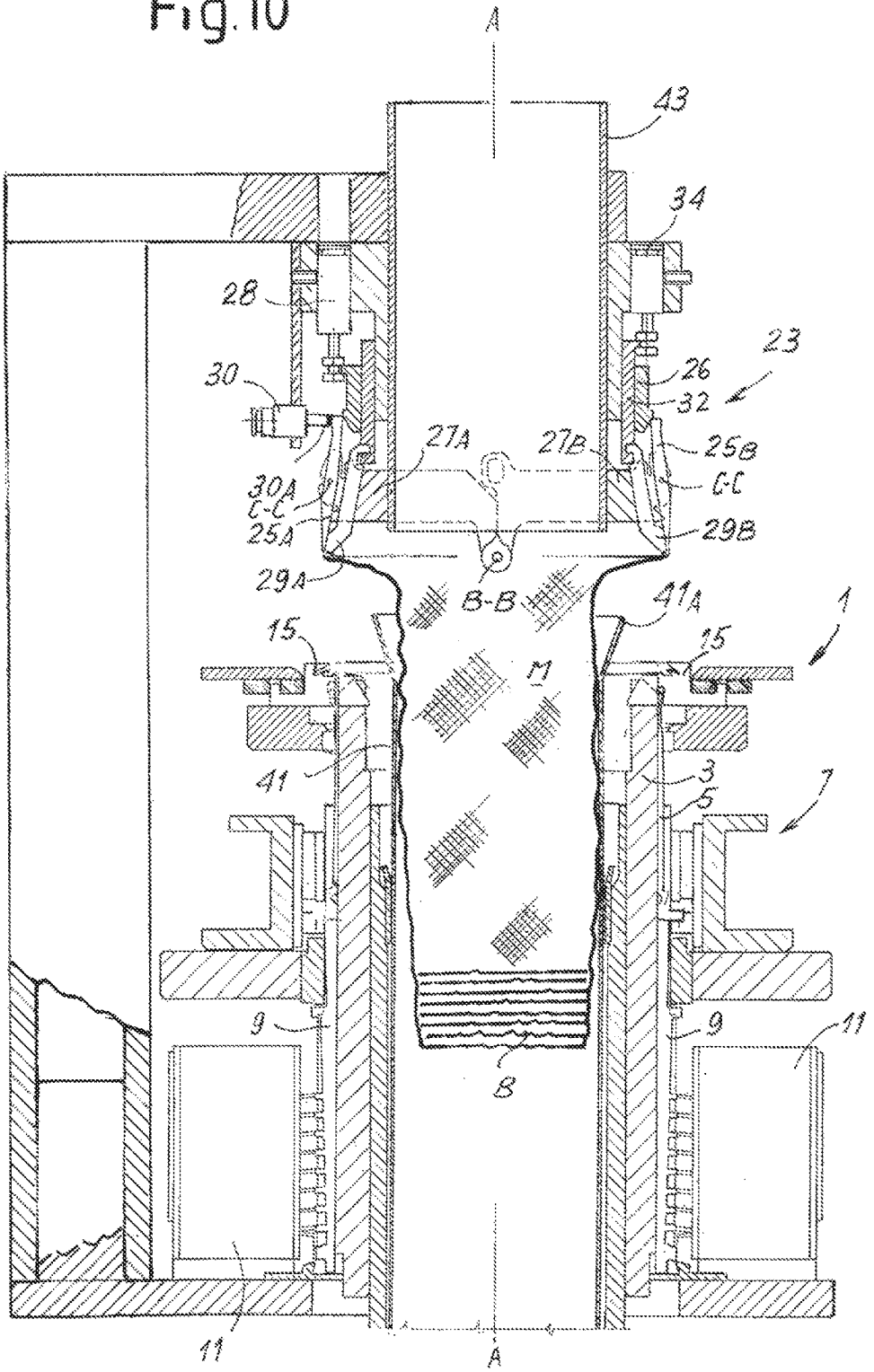

Now the knitted tubular article M is engaged along the final edge, in correspondence of, or near, the last course MR of stitches, by the pick-up hooks 25A, 25B and is released from the needles 5 of the cylinder 3. Pick-up hooks 25A engage a first portion of the final edge of the tubular knitted article, while pick-up hooks 25B engage a second portion of said final edge, said portions being substantially semi-circular. The pick-up member 23 can be thus raised and removed from the cylinder 3 of needles 5. FIG. 10 shows the step of rising the pick-up member 23 to remove the tubular article M engaged to the pick-up hooks 25A, 25B, removing it from the inside of the cylinder 3 of the needles 5 to transfer it to the sewing or linking machine.

To protect the knitted tubular article M and prevent it from becoming caught in the knitting members and in particular in the needles 5 and the sinkers 15, a tubular member 41 may be provided inside the cylinder 3 of the needles 5 and coaxial therewith; this tubular member 41 can be raised, in this step, so that the upper edge 41A thereof moves up beyond the ring of sinkers 15.

Figure 11:
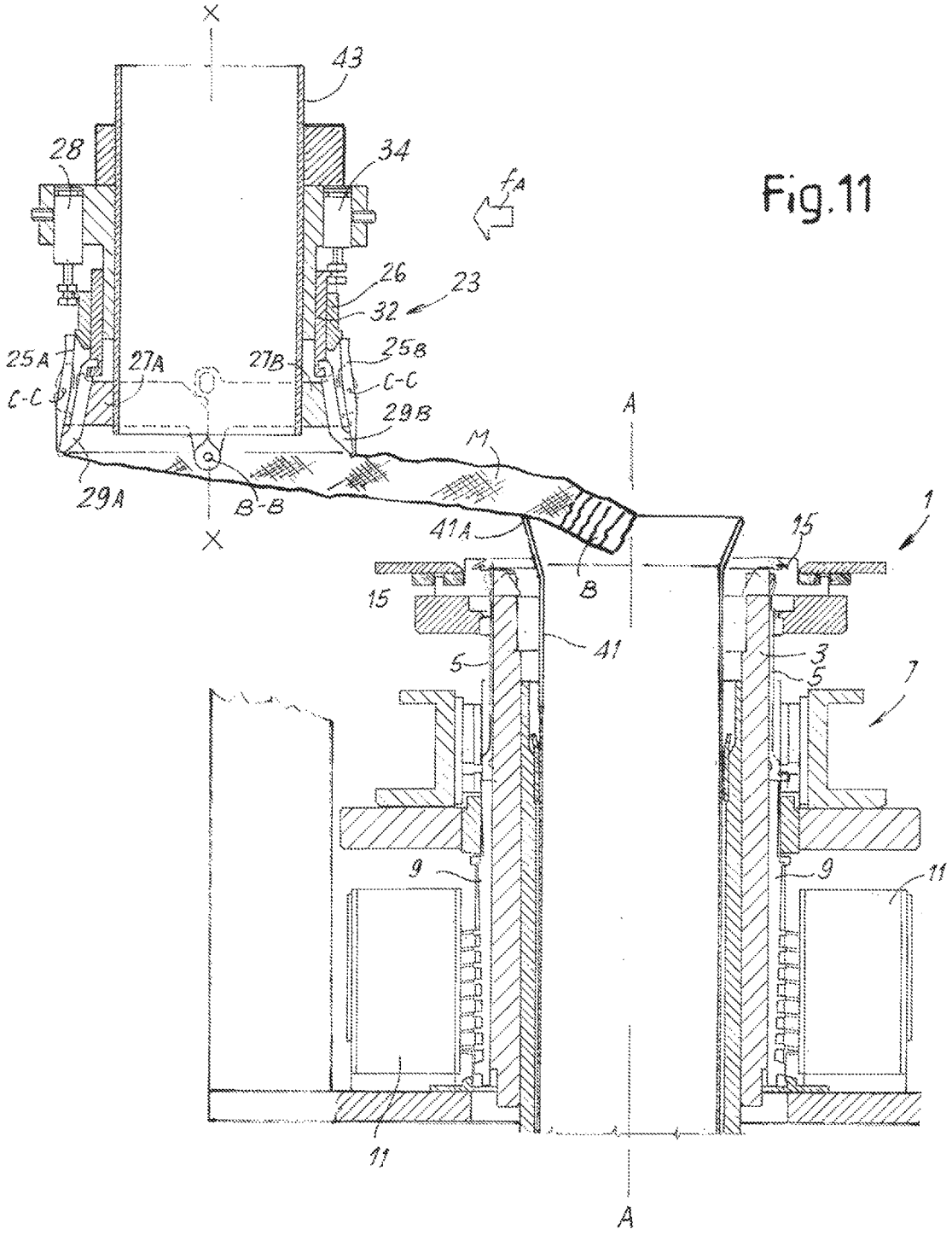
Figure 12:
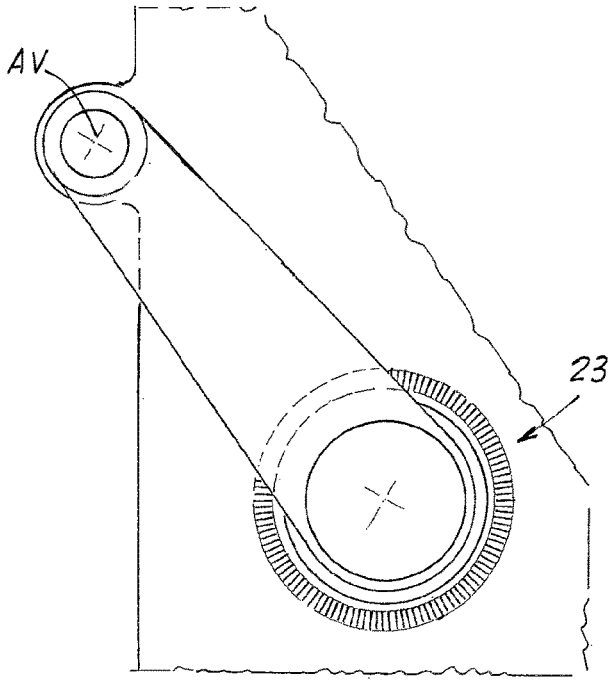
FIGS. 12 and 13 show schematic plan views of the circular knitting machine and the pick-up members for the tubular knitted articles in two different positions.
Figure 13:
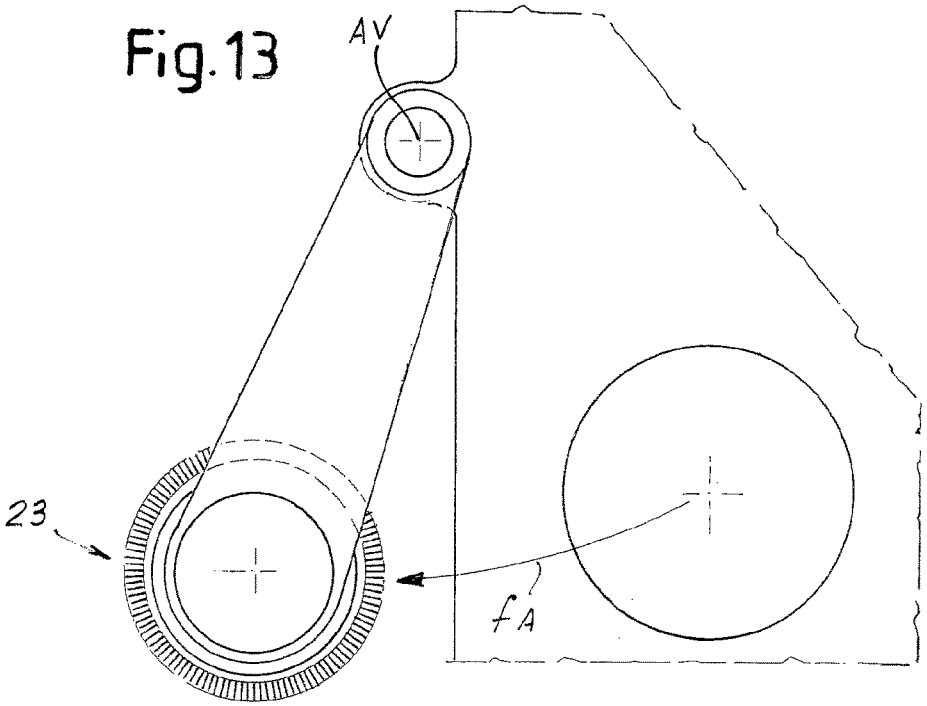
Figure 14:
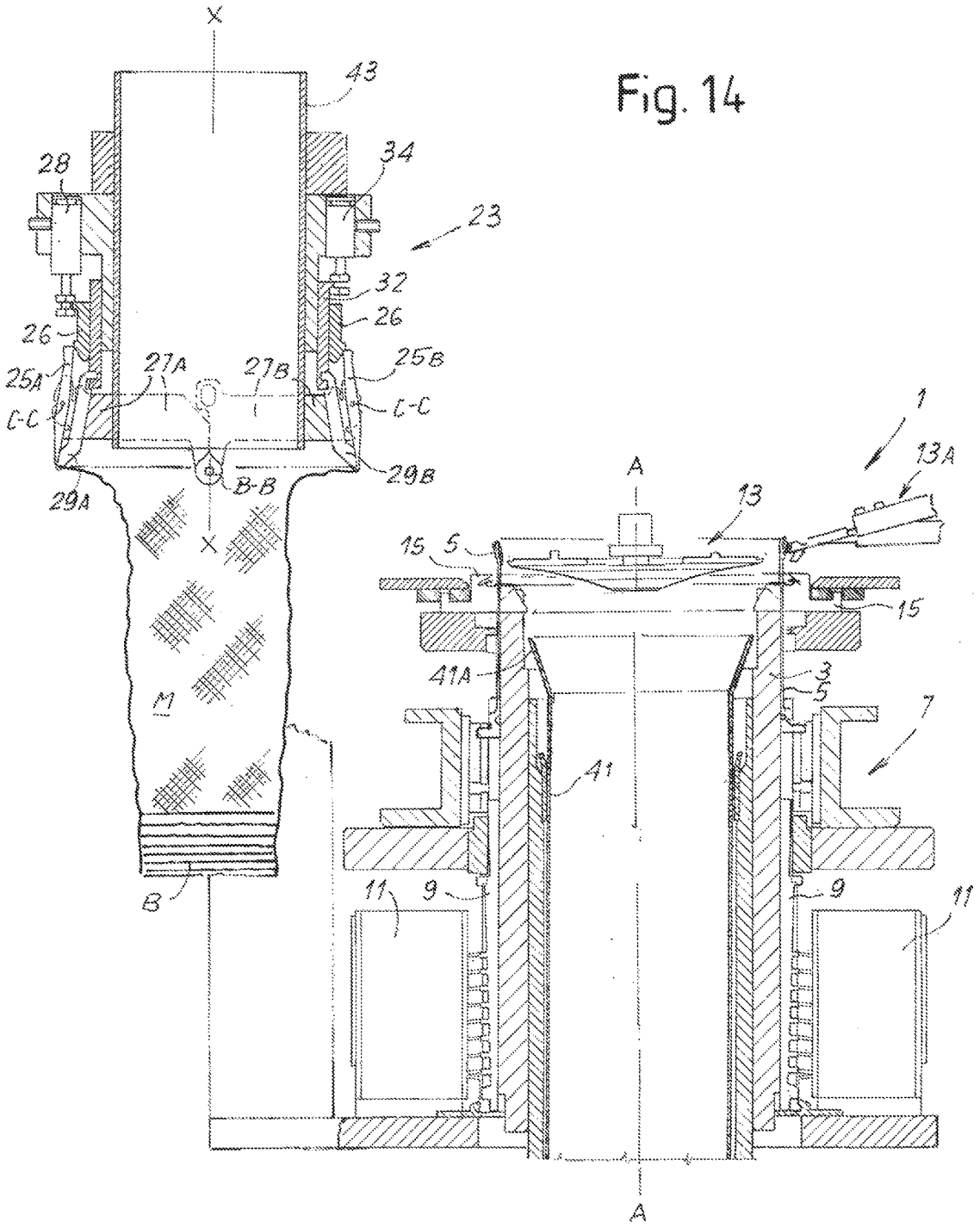
FIG. 14 shows a vertical section of the circular knitting machine and the pick-up member while moving away from the needle cylinder.

In FIG. 11 the pick-up member 23 is moving (arrow fA) in cross direction to remove the tubular knitted article M and transfer it to the sewing or linking machine. In FIG. 14 the tubular article M has been completely removed from the circular knitting machine 1. FIGS. 12 and 13 are top views of the movement for removing the tubular knitted article M from the circular knitting machine 1. In this embodiment, this is a rotary motion (arrow fA) around a vertical axis AV, but it is also possible that the pick-up member 23 moves for instance according to a translation movement. Once the tubular knitted article M has been removed from the inside of the cylinder 3 of the needles 5, the circular knitting machine 1 may start knitting a new tubular article M and the dial 13 and the yarn guides 13A have been therefore put into working position again (see FIG. 14).

Before ending to knit the tubular article and transfer it to the pick-up hooks, one or more run-proof courses, i.e. courses which are capable of resisting to unravelling, may be knitted according to known techniques, described in greater detail below. In this way the system is more reliable, preventing courses from running even if the article is engaged by the pick-up members at points below the last course of formed stitches, i.e. in correspondence of stitches of the penultimate and/or previous last courses, taken by the pick-up hooks inserted between the needles 5.

Figure 15:
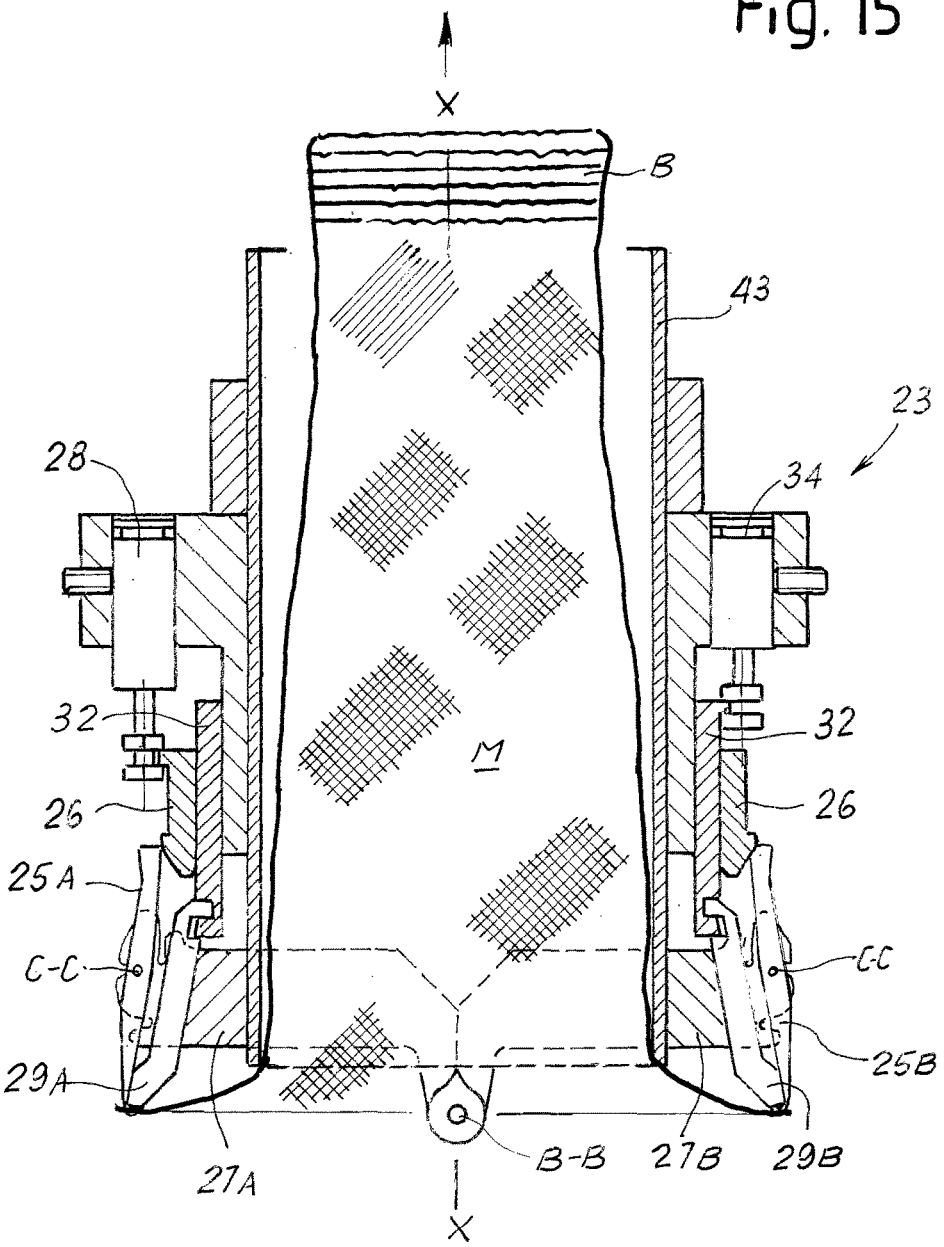
FIGS. 15 to 17 show sections according to a vertical plane of the pick-up member while turning the article inside out and overturning the half-rings of pick-up hooks.

In the step shown in FIG. 15 the tubular knitted article M is turned inside out by means of a suction tube 43, while remaining engaged to the pick-up hooks 25A, 25B of the pick-up member 23.

Figure 16:
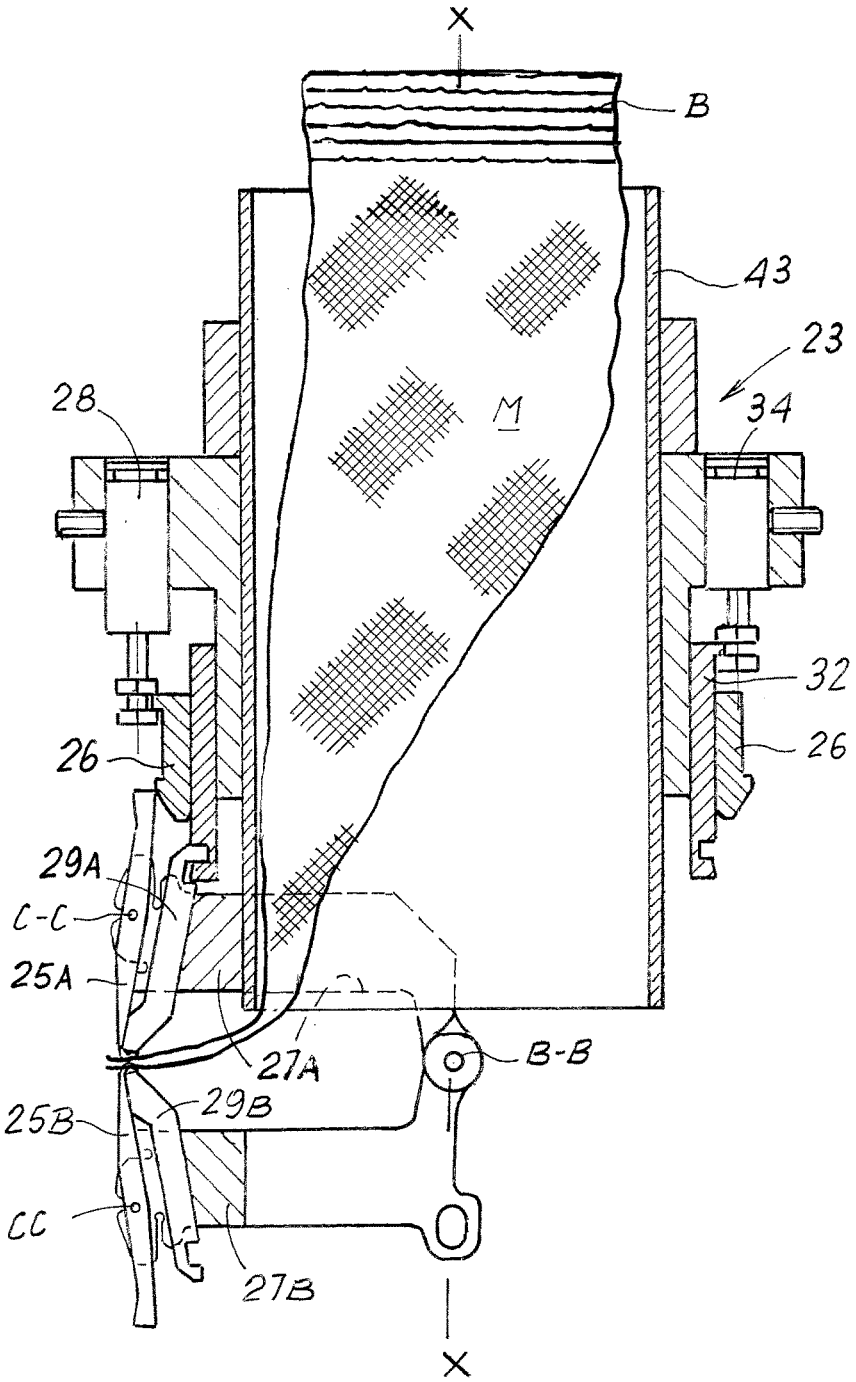

To sew or link the toe the half-ring of pick-up hooks 25B is now overturned by 180° by rotating the support 27B with respect to the support 27A around the axis B-B, so as to face the half-ring of pick-up hooks 25A, as shown in FIG. 16. In this arrangement the pick-up hooks 25A and the pick-up hooks 25B face each other and the two semi-circular edge portions of the edge formed by the last course of stitches of the toe of the tubular knitted article M are engaged to the two half-rings of pick-up hooks 25A, 25B opposite to each other.

Figure 17:
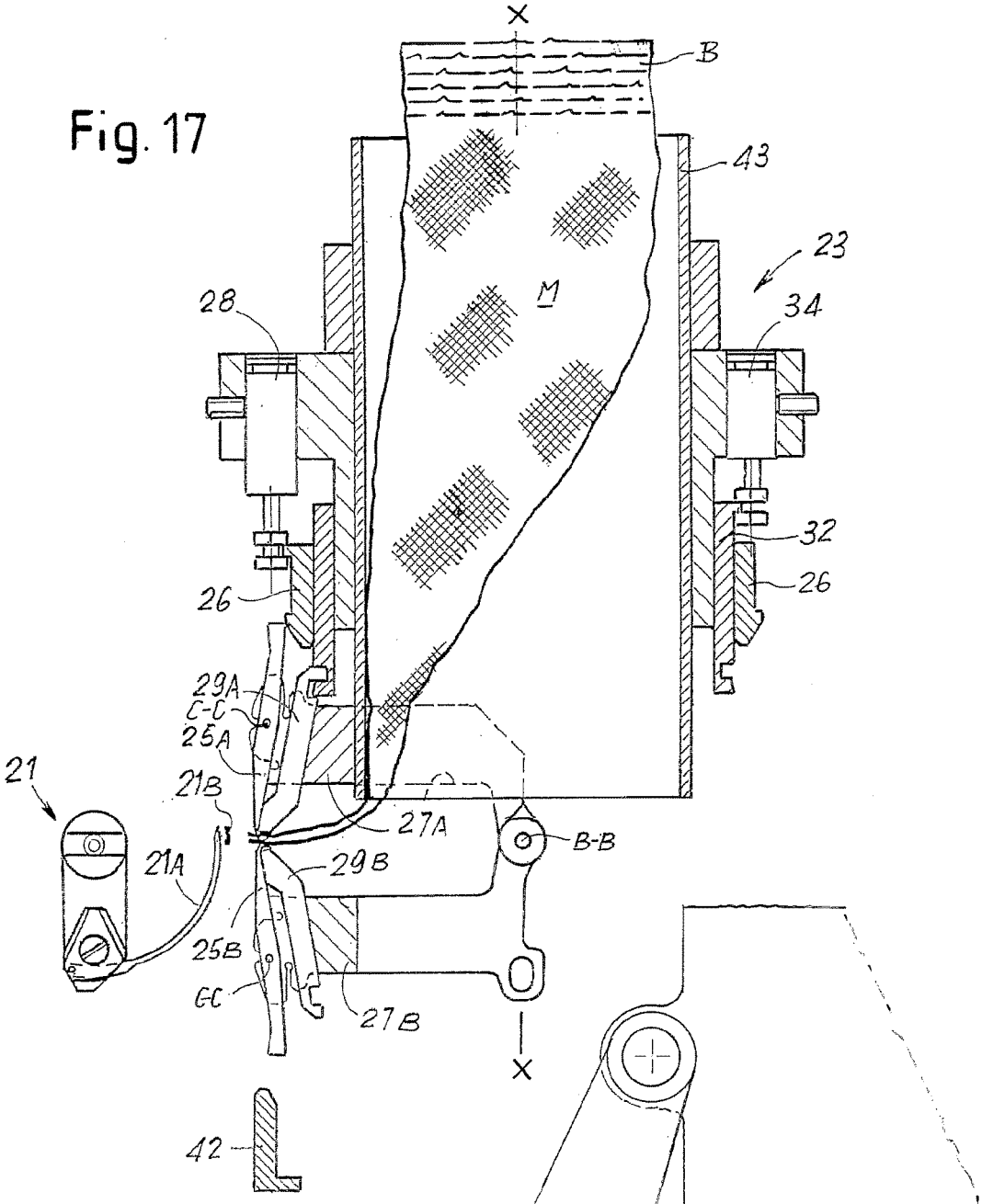
Figure 18:
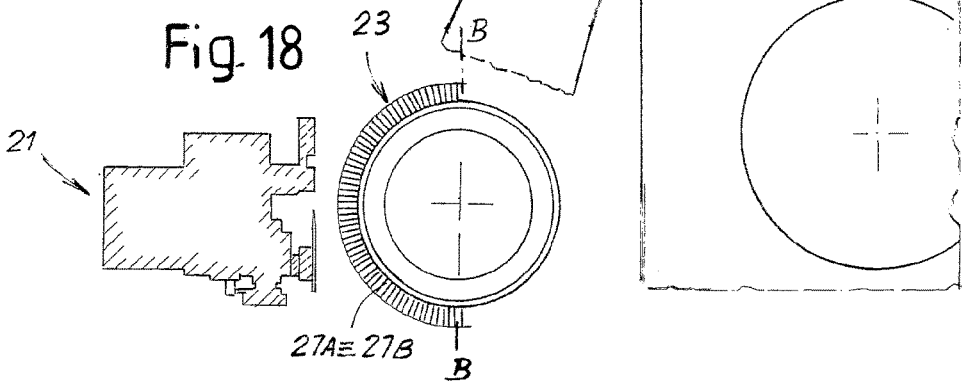
FIG. 18 shows a schematic plan view corresponding to the step of FIG. 17.
Figures 19, 20:
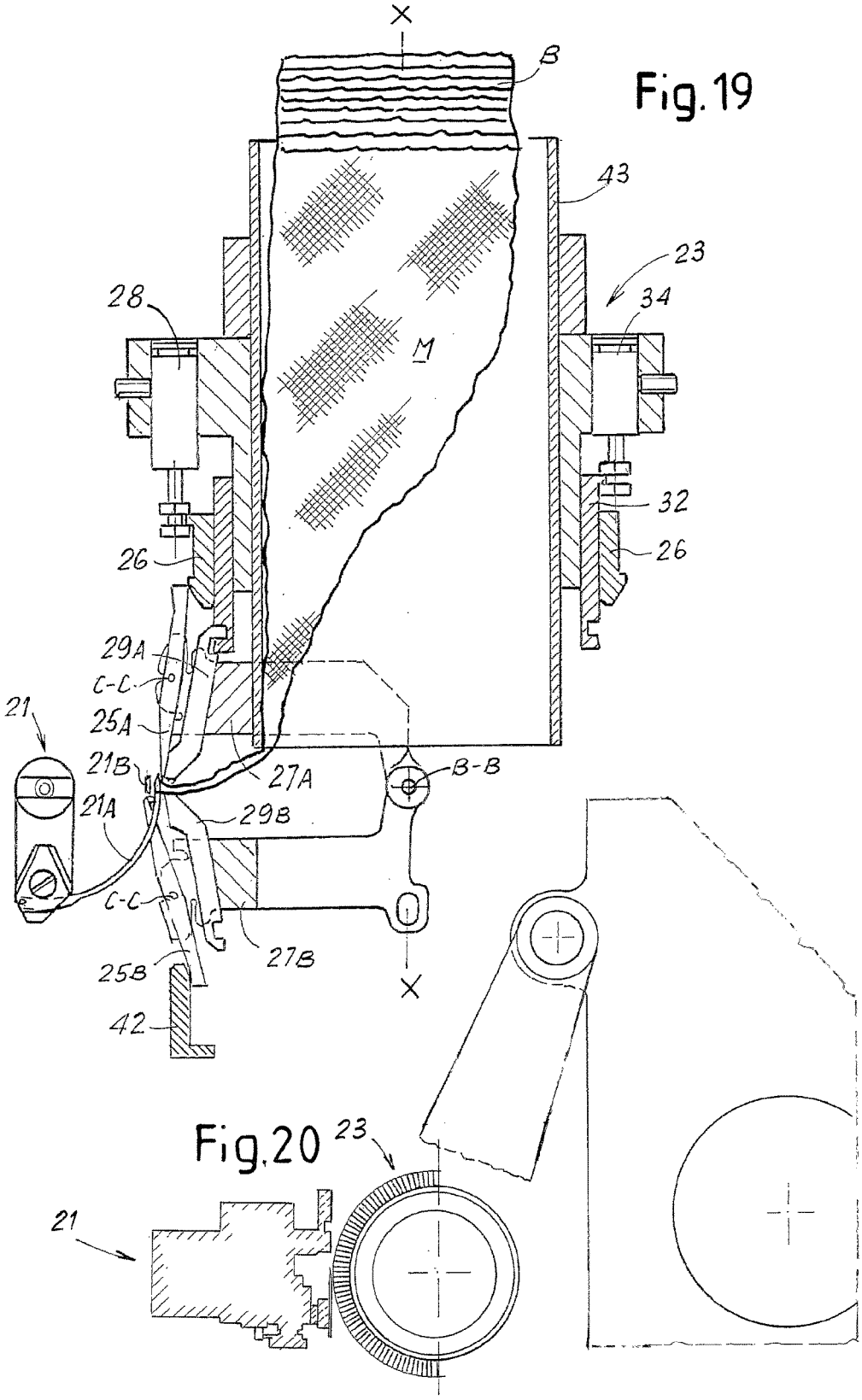
FIG. 19 shows a vertical section of the pick-up member at the beginning of the toe closing procedure.
FIG. 20 shows a plan view corresponding to the step of FIG. 19.

In FIG. 17 the pick-up member 23 has approached the sewing or linking machine 21. FIG. 18 illustrates a top plan view of the linking machine or device and the pick-up member 23 in the mutual position of FIG. 17. In FIG. 19 the sewing or linking machine has been moved towards the two half-rings of pick-up hooks with the respective closure latches in the position where sewing or linking can be performed. 21B indicates an index of the sewing or linking machine 21. See also FIG. 20, showing a schematic plan view of this step, wherein the sewing or linking machine 21 moves towards the pick-up member 23.

Figure 21:
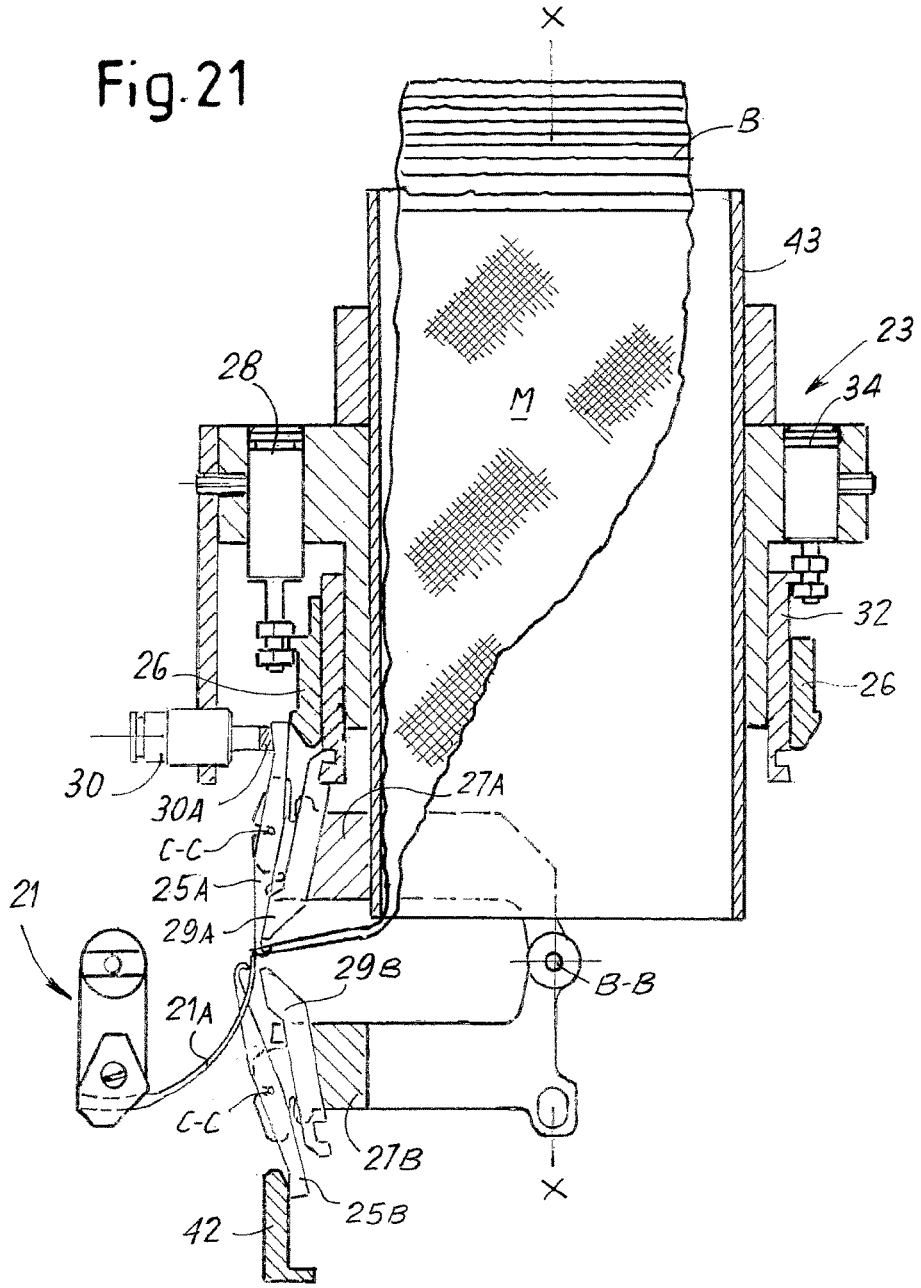
FIGS. 21 and 22 show vertical sections of the pick-up member in the final step of sewing or linking of the toe.

In FIG. 19 the pick-up hooks 25B are gradually opened by pivoting the pick-up hooks 25B around the axes C-C by means of a fixed cam 42, while the pick-up member 23 rotates around its own axis to allow sewing or linking along the arc defined by the half-rings of pick-up hooks and closure latches. See also the plan view of FIG. 20. In FIG. 21 also the closure latches 29A have been opened by raising the annular cam 32 to finish the sewing or linking.

Figure 22:
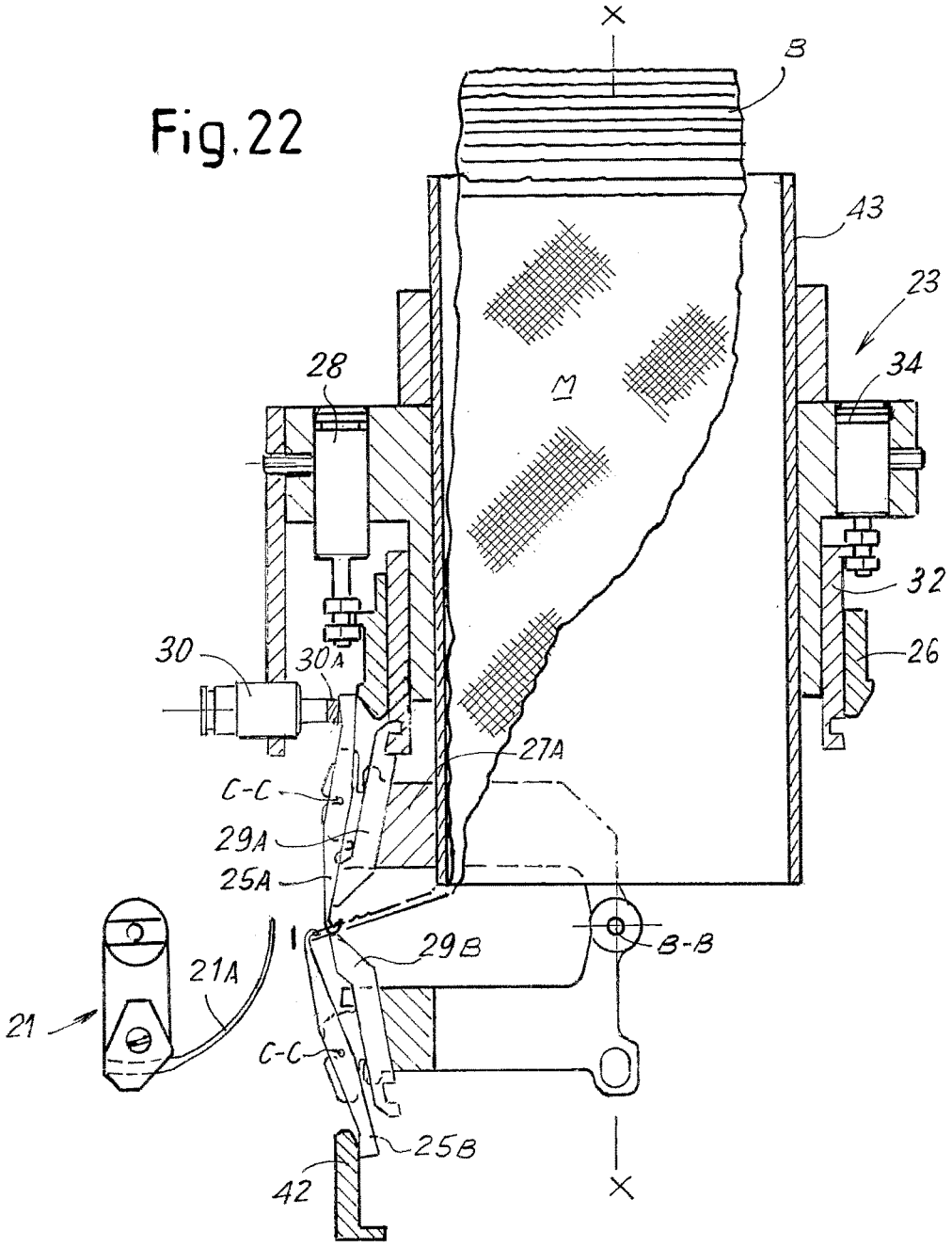

In FIG. 22 the sewing or linking has been completed and the remaining chain is cut.

It should be understood that the various steps of the sewing or linking process are preferably performed sequentially during the rotation of the two half-rings of pick-up hooks and closure latches; therefore, the steps of creating the sewing or linking stitches and of subsequently opening the closure latches 29B are performed in sequence along the semi-annular extension of the half-rings of pick-up hooks and closure latches.

A more detailed description of the actual sewing or linking process will be given later on.

Figure 23:
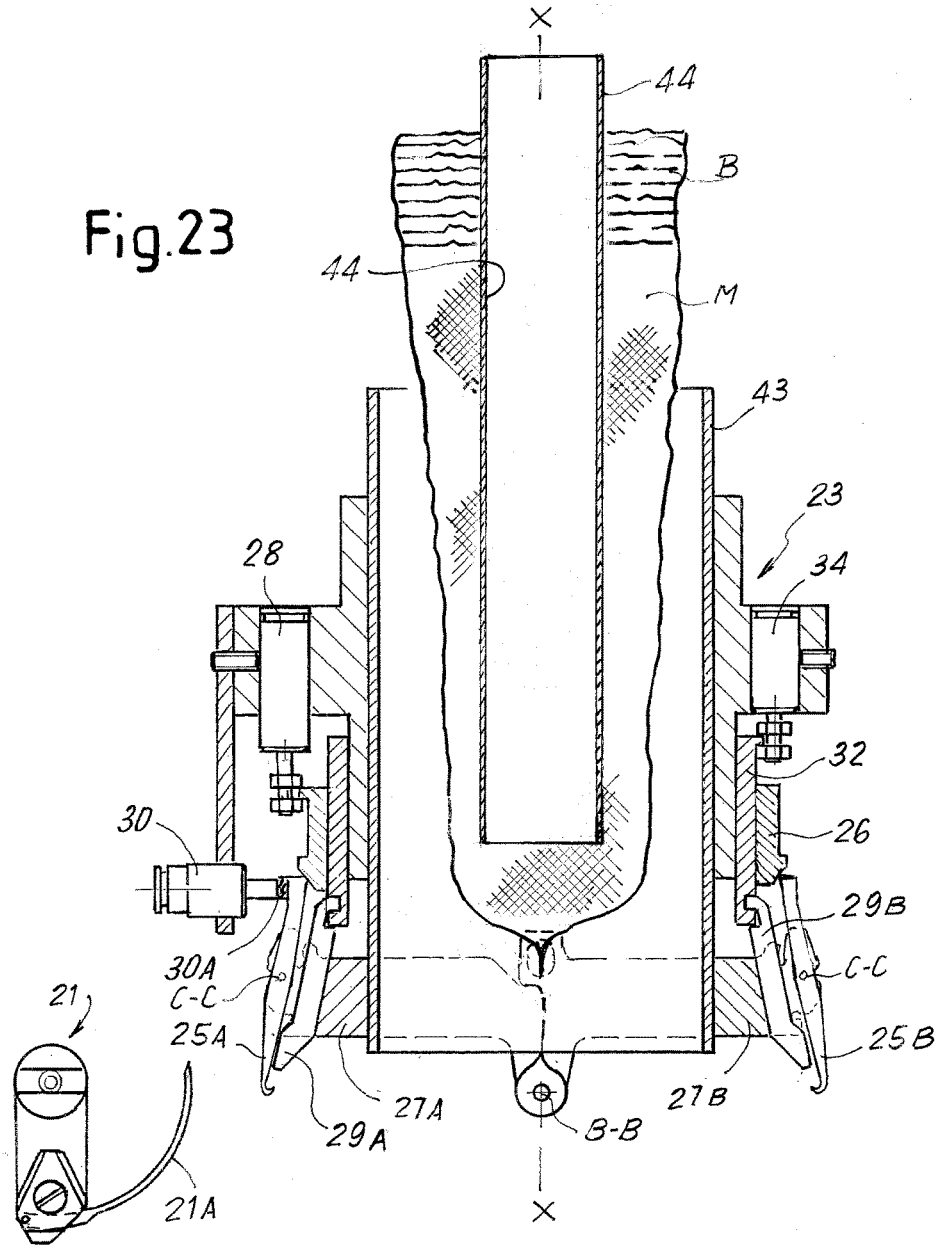
FIGS. 23 and 24 show vertical sections of the pick-up member while the tubular article is turned outside in after the toe has been closed
Figure 24:
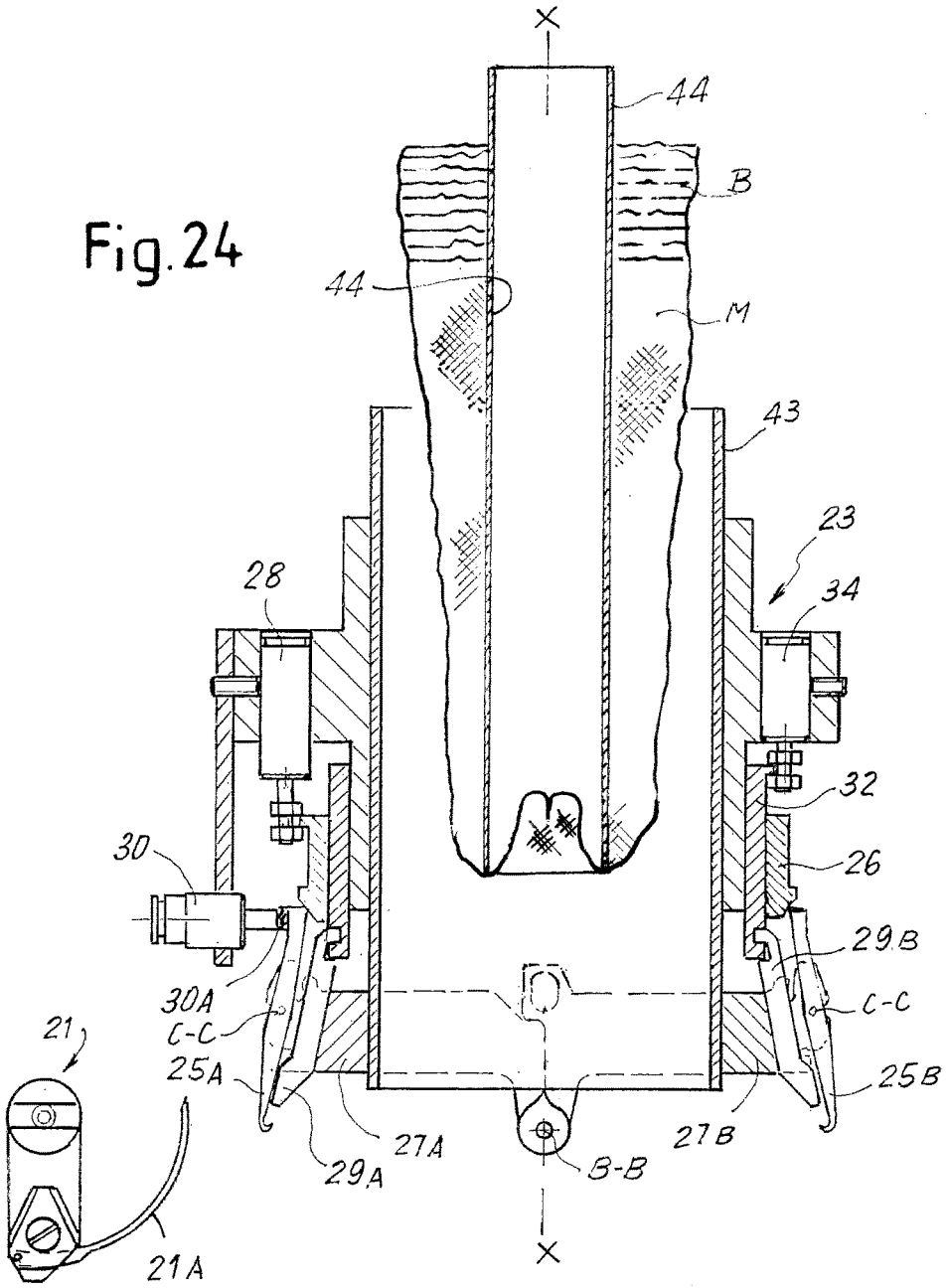

In FIG. 23 the two half-rings of pick-up hooks 25A, 25B and closure latches 29A, 29B have been brought again to a coplanar position, the tubular article M has been removed from the pick-up hooks and is still held upwards by means of the suction tube 43. The pick-up hooks 25A can be opened by means of a cam 30A actuated by an actuator 30 carried by the support onto which the pick-up member 23 is installed.

In this step, coaxial with the tube 43 a further suction tube 44 has been provided, inside which the tubular knitted article M is sucked and therefore reversed (FIG. 24) so as to bring the sewing or linking inside the same tubular knitted article M.

Figure 25:
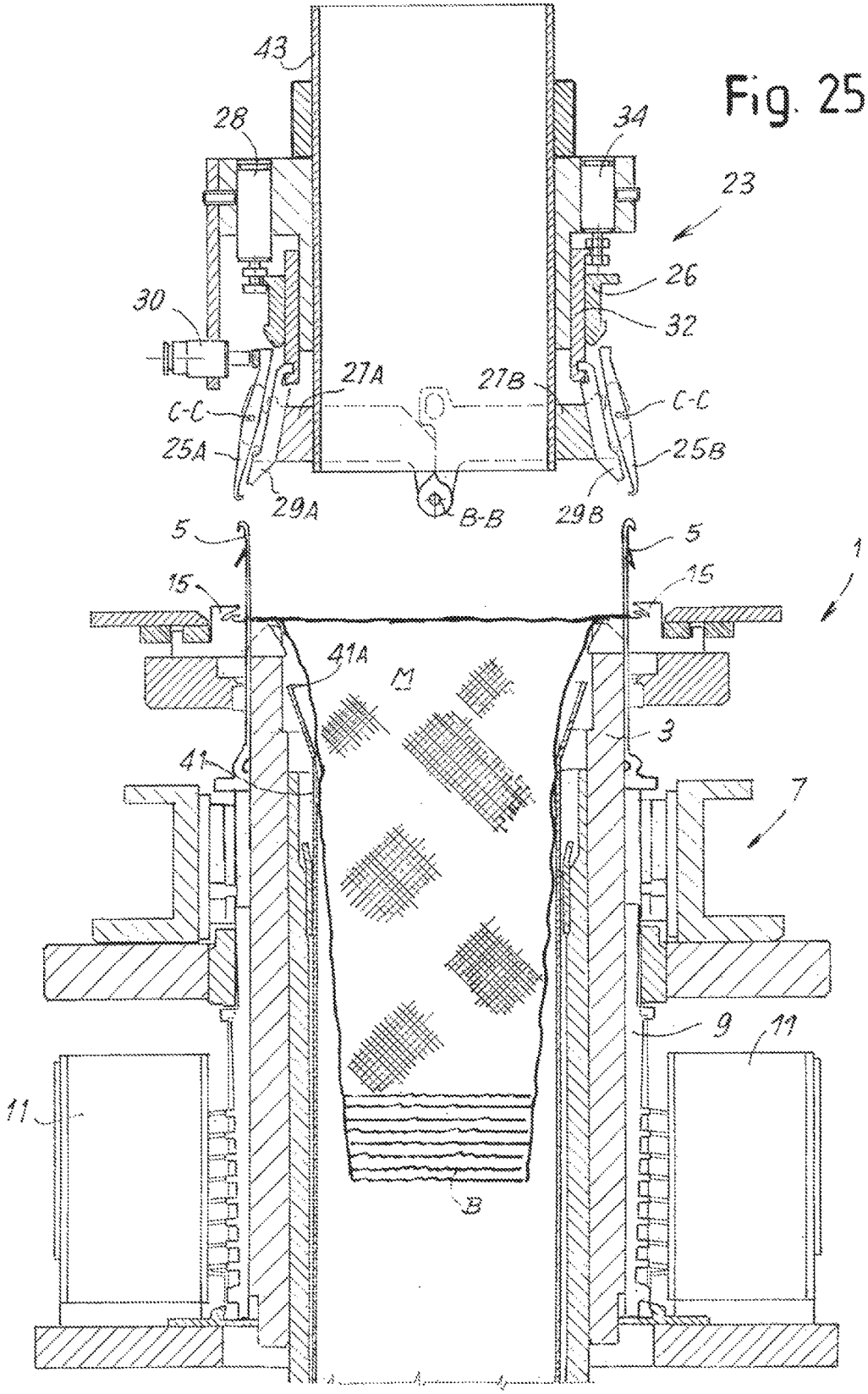
FIGS. 25, 26, and 27 show vertical sections of the circular knitting machine when the tubular knitted article begins to be transferred to the pick-up member in a modified embodiment.
Figure 26:
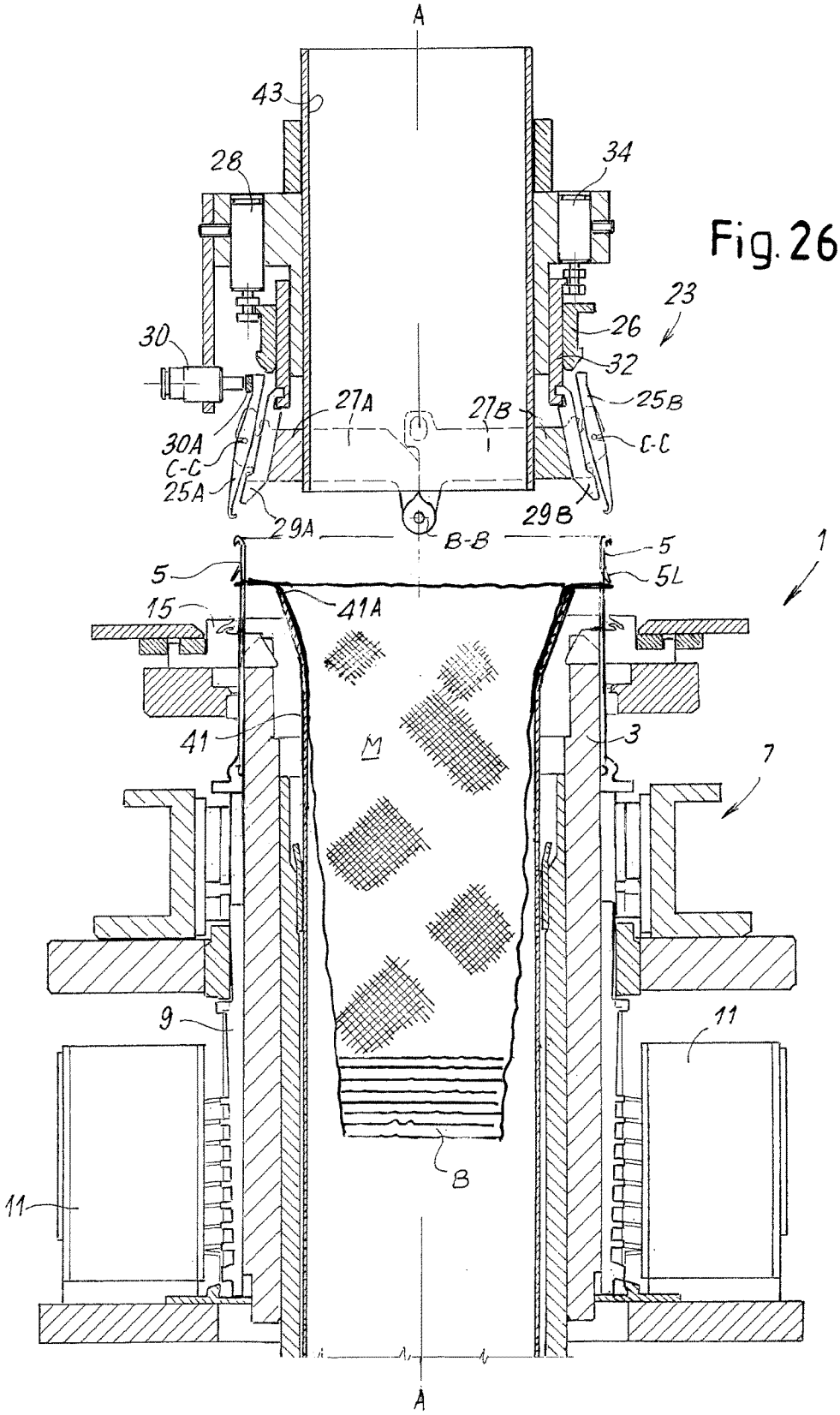
Figure 27:
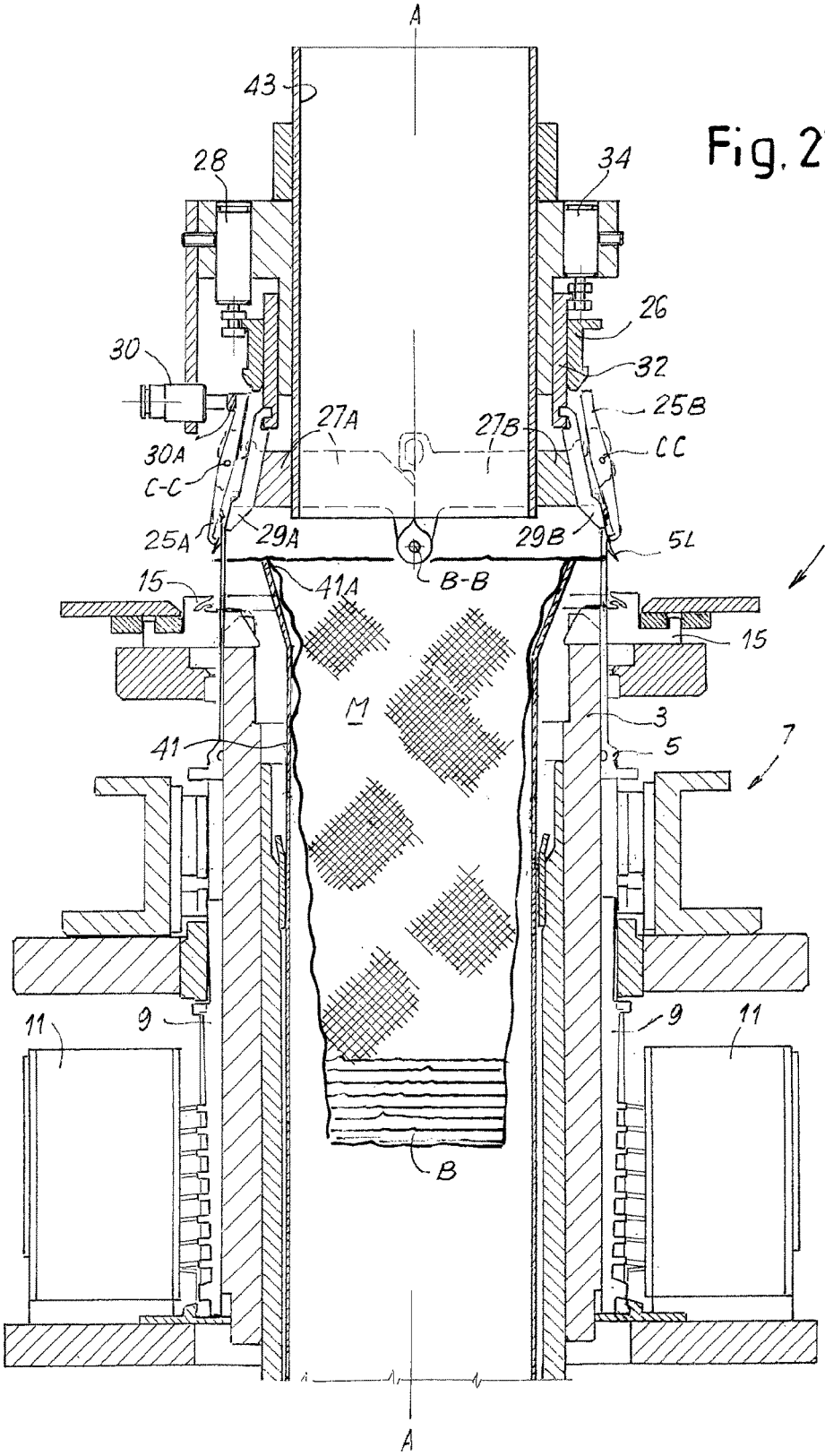

FIGS. 25, 26 and 27 show a modified embodiment of the invention, with particular reference to the step of transferring the last course MR of stitches of the tubular knitted article M from the needles 5 of the cylinder 3 to the pick-up hooks 25A, 25B of the pick-up member 23. In this embodiment the last course of stitches engaged to the needles 5 is raised from the loop formation plane P by means of the tubular member 41, arranged coaxially inside the cylinder 3 of needles 5. In FIG. 25 the pick-up member 23 is coaxial with and above the cylinder 3 of the needles 5. The needles 5 are raised and hold the last course of stitches of the tubular knitted article formed by the knitting machine 1. In FIG. 26 the tubular member 41 has been moved upwards thus raising the tubular knitted article M from the loop formation plane P. The pick-up member 23 is still above the cylinder 3 of the needles 5.

In this case, advantageously only one hook can be inserted between two consecutive needles of each pair of needles 5. In the step of cooperation between pick-up hooks and knitted fabric of the article M, there are no sinkers 15 between consecutive needles 5. The pick-up hooks may be thicker and/or arranged at a greater reciprocal distance.

In FIG. 27 the pick-up member 23 has been lowered and the pick-up hooks 25A, 25B have been inserted between the needles 5. As the whole tubular knitted article M has been raised from the loop formation plane, it is therefore possible to close all the pick-up hooks 25A, 25B simultaneously, making them oscillate around the axis C-C of articulation to the supports 27A, 27B, then closing the closure latches 29A, 29B. Once the closure latches 29A, 29B have been closed, the cycle continues as described with reference to the previous figures.

The movement of rotation of the pick-up hooks 25A, 25B and the closure latches 29A, 29B around the axis A1-A1 of the pick-up member 23 may be provided by means of an electric motor, not shown, whose movement is electronically coordinated and timed with the motor controlling the rotation of the needle cylinder 3.

FIGS. 28 and 29 show a modified embodiment of the circular knitting machine 1 and the pick-up member 23. The same numbers indicate identical or equivalent parts to those described above. In this embodiment, the pick-up member 23 is carried by a support shaft 101. Inside the pick-up member 23 a tubular member 109 is provided coaxially with the same pick-up member 23 and torsionally coupled to it. This inner tubular member 109 may be torsionally coupled to a suction tube 110 that is inside the needle cylinder 3. This coupling may be provided by means of a tab 111 integral with the suction tube 110 and a notch 113 integral with the tubular member 109. In an embodiment not shown, a similar coupling may be provided between the tubular member 109 and the pick-up member 23. A further key may be for instance provided for the connection to the pick-up member 23. In other embodiments, not shown, a mechanical coupling may be provided between the dial 13 and the pick-up member 23 for moving this latter.

The suction tube 110 is torsionally coupled to one first lower toothed wheel 115, engaging with one first idle gear 117 mounted on a common shaft to a second idle gear 119. The pair of coaxial idle gears 117, 119 receives the rotary motion by means of a second toothed wheel 121, torsionally coupled to the needle cylinder 3, that is made rotate by a motor, not shown. In this way the rotary motion of the needle cylinder 3 is transmitted to the pick-up member 23 when it is axially aligned with the needle cylinder 3.

In the previous embodiments a pick-up member 23 has been described, which is provided with two half-rings of pick-up hooks 25A, 25B, wherein each pick-up hook 25A, 25B is in turn provided with a respective closure latch 29A, 29B to hold the stitches of the last course or courses.

Figure 30:
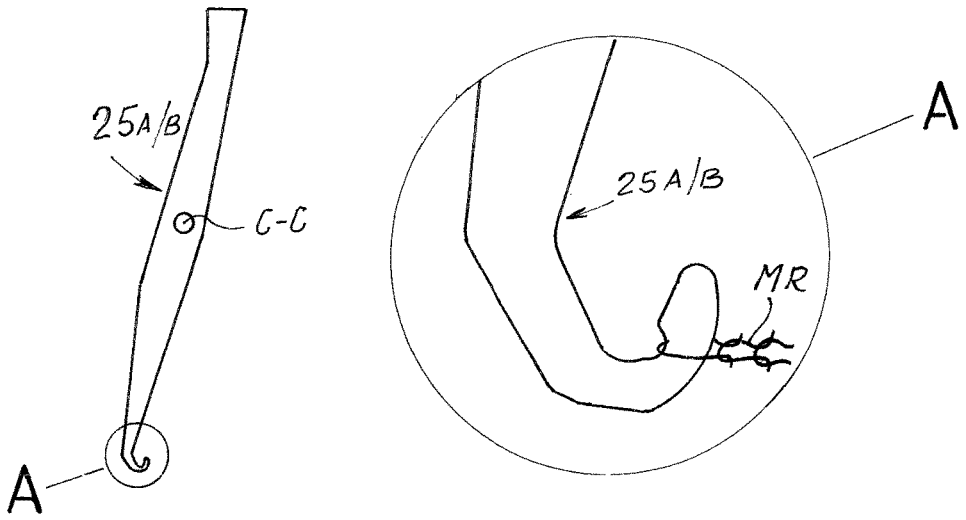
FIG. 30 shows a detail of a modified embodiment of the pick-up hooks of the pick-up member.

According to other embodiments, if one or more last courses are made of elastic thread, only pick-up hooks can be used, without closure latches. The pick-up hooks have preferably an improved shape for picking the stitches up in a more reliable way, as shown in the enlargement of FIG. 30, showing a single hook 25 and an enlargement of the end thereof, engaging a stitch of the last course MR. The active end of the hook 25 has advantageously a notch that is deeper than that of the pick-up hooks illustrated in the figures previously described, to better hold the respective stitch (by means of the only elasticity of the thread).

Figure 31:
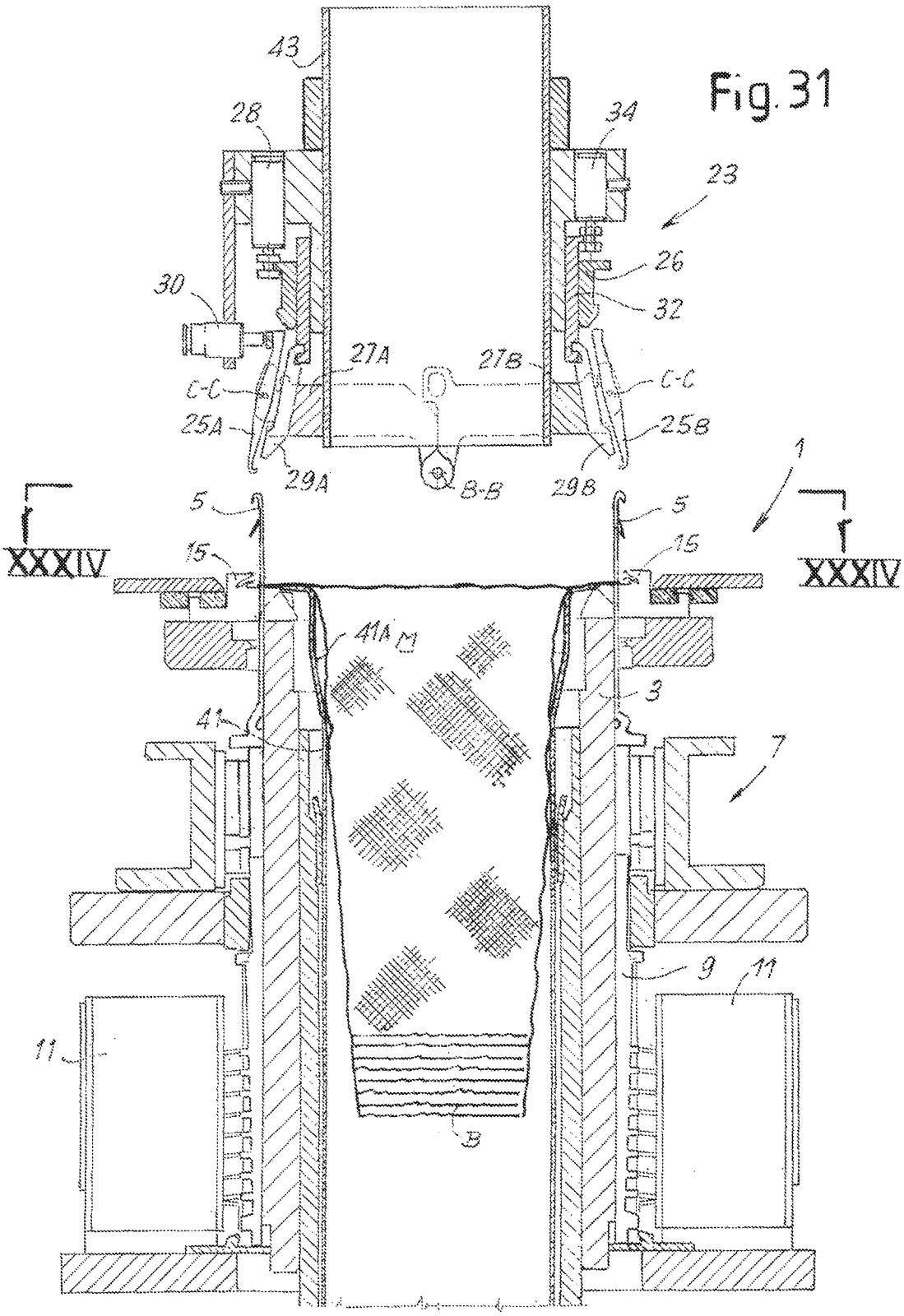
FIGS. 31 to 33 show similarly to FIGS. 25 to 27, a sequence when the tubular knitted article is removed from the needle cylinder.
Figure 32:
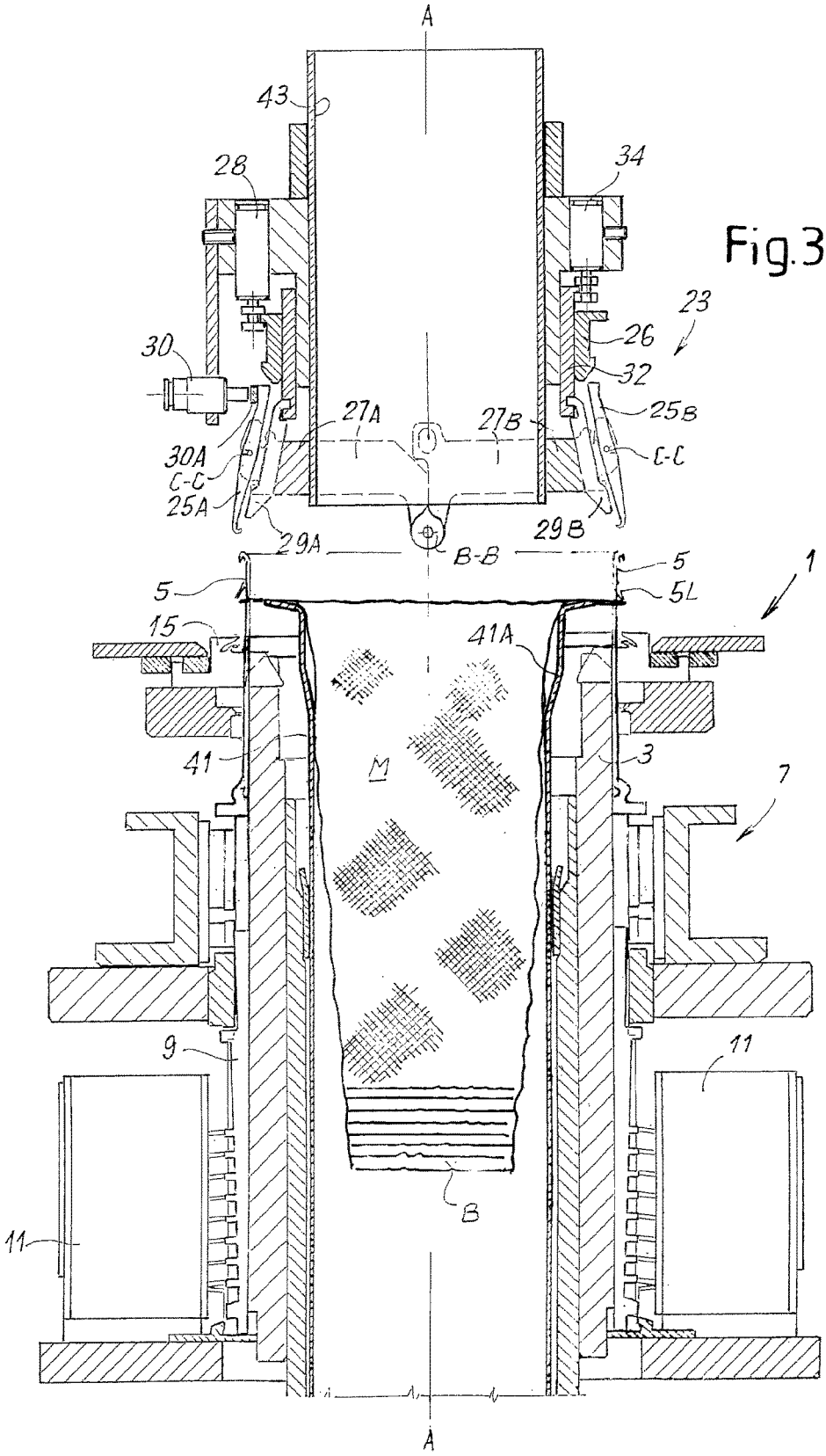
Figure 33:
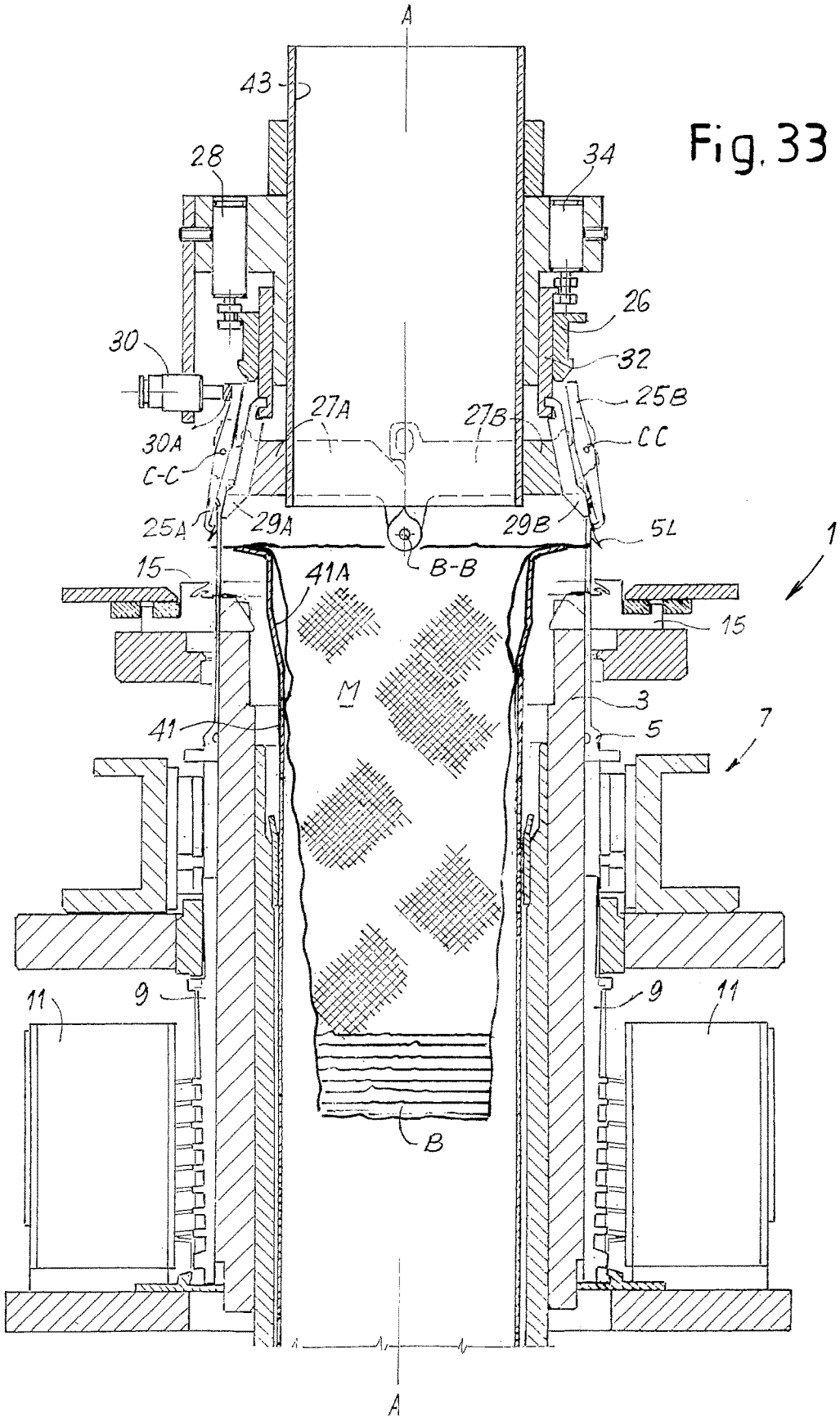

FIGS. 31, 32, and 33 show a modified embodiment of a sequence for transferring the stitches of the final edge of the tubular knitted article to the pick-up hooks 25A, 25B. According to this embodiment, the stitches of the last course are transferred from the needle cylinder to the pick-up member by raising the tubular knitted article by means of a tubular member 41, arranged inside the cylinder 3 of the needles 5 and coaxial with it, that is raised so that its own upper edge 41A moves up above the ring of sinkers 15, analogously to what illustrated in FIGS. 25 to 27. In this embodiment the upper edge 41A of the tubular member 41 has however a greater diameter than the diameter illustrated in FIGS. 25 to 27 and greater than the diameter defined by the circular alignment of the sinkers 15. In other words, the sinkers 15 and the upper edge 41A of the tubular member 41 cross each other. This arrangement is possible thanks to the fact that the upper edge 41A of the tubular member 31 has a plurality of radial notches 41B corresponding to the sinkers 15, so that these latter can be inserted into the radial notches while the tubular member 41 is raised.

Thanks to this arrangement and the size of this tubular member 41, the edge 41A is significantly nearer to the stems of the needles 5 and therefore guides the tubular knitted article M in a more precise manner during the rising movement thereof shown in the sequence of FIGS. 31 to 33.

In the description above reference has been made to a system for joining the two opposite edge portions of the toe by sewing or linking them. Sewing or linking devices are known to those skilled in the art, and therefore will not be described in greater detail. However, the action of the sewing or linking members on the stitches or loops of the edge portions will be described in some detail here below, for a more complete appreciation of the novel features of the method disclosed herein.

Figure 34:
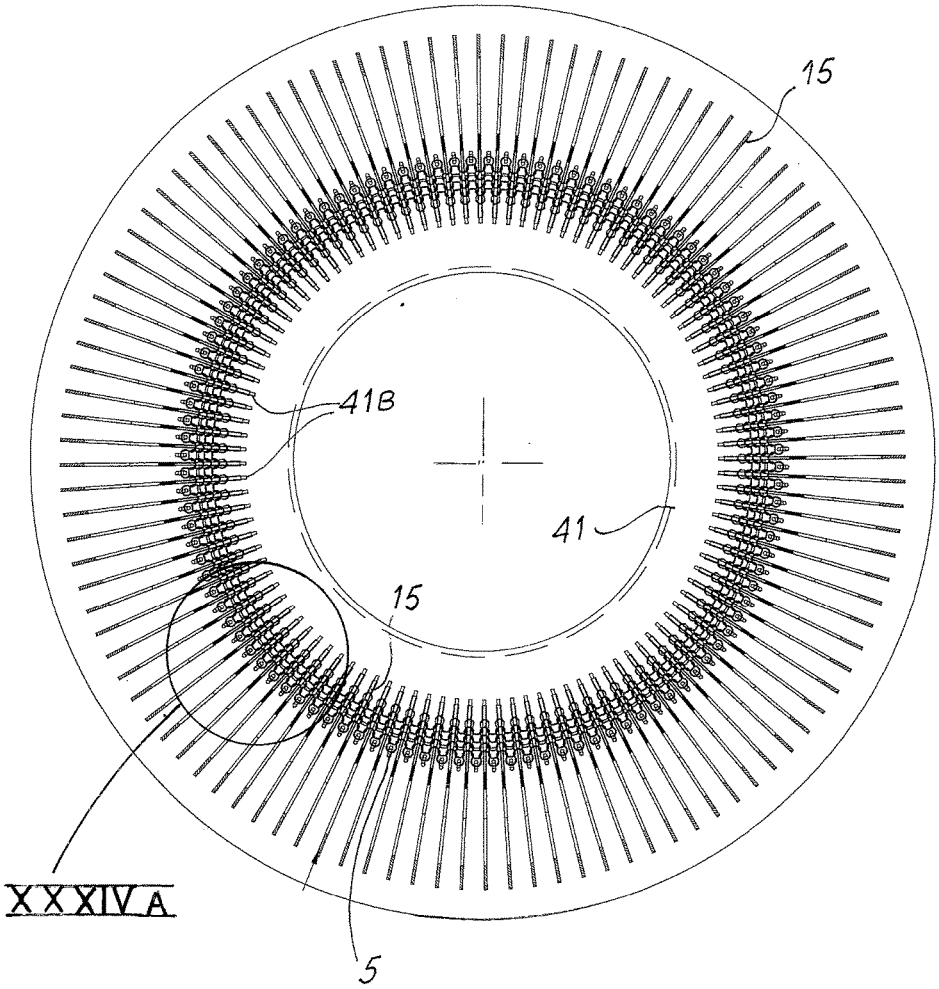
FIG. 34 shows an enlarged plan view according to the line XXXIV-XXXIV of FIG. 31.
Figure 34A:
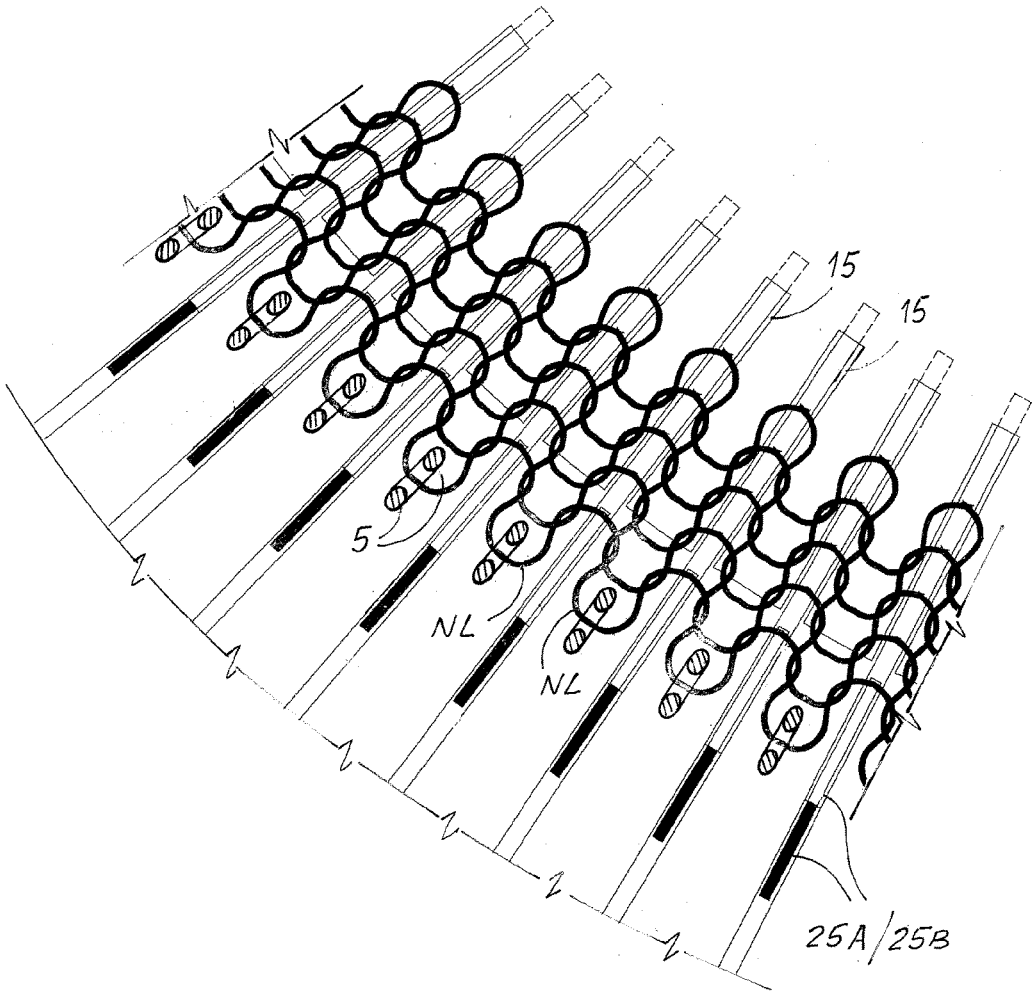
FIG. 34A shows an enlargement of a detail of FIG. 34.
Figure 35:
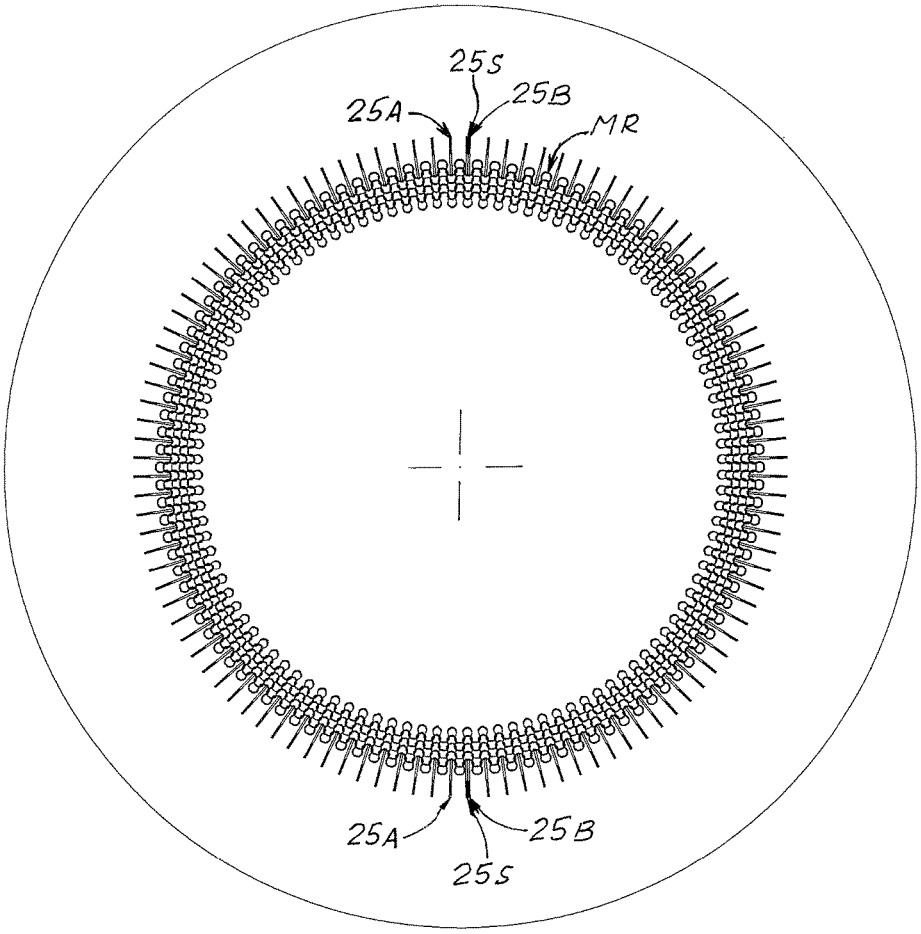
FIG. 35 schematically shows the arrangement of the last courses of stitches engaged to the two half-rings before these latter rotate one over the other by 180°.

FIGS. 34, 35, and 36 show a sequence of picking up the tubular knitted article M from the cylinder of the needles 5 to link the portions of the toe edge. FIG. 34 shows a plan view of the final step of knitting of the tubular knitted article M. FIG. 35 is a schematic view orthogonal to the axis of the pick-up member 23 of the ring of the pick-up members, each of which engages, in this case, the last stitch formed before forming the last course engaged by the needles 5 in the pick-up step. FIG. 34A is an enlargement of a portion of FIG. 34. In FIG. 34A the needles 5 are shown in cross-section. Reference number NL denotes the so-called needle loops formed by the needles 5 in the last revolution of the needle cylinder. The needle loops NL are joined to one another by respective portions of yarn, which are labeled SL and usually named sinker loops. The stitches of the last course are thus still engaged by the needles 5 which have formed them. As can best be appreciated from FIG. 34A, in this stage the pick-up hooks 25A, 25B engage the respective two edge portions of the edge, which surrounds the open toe of the tubular knitted article M, at the sinker loops SL, i.e. between adjacent needle loops NL.

In FIG. 36 one of the two half-rings of pick-up hooks has been overturned over the other. In this embodiment, in the diameter area where a half-ring of pick-up hooks is overturned over the other one, auxiliary pick-up hooks 25S are provided in correspondence of the axis B-B of rotation, holding the stitches corresponding to the overturning line. Practically, in this area two pick-up hooks, respectively 25B and 25S, are inserted between two consecutive needles 5. After the half-ring has been overturned, the hook 25B is arranged facing the corresponding adjacent hook 25A, while the auxiliary hook 25S remains in the original position and holds the last end stitch of the half-course to be linked.

FIG. 36A shows an enlargement of one of the ends of the superposed half-courses of stitches and of the superposed half-rings of pick-up hooks 25A, 25B. Reference number 21A indicates the needle of the sewing or linking machine that starts to sew the two superposed half-courses.

Figure 36B:
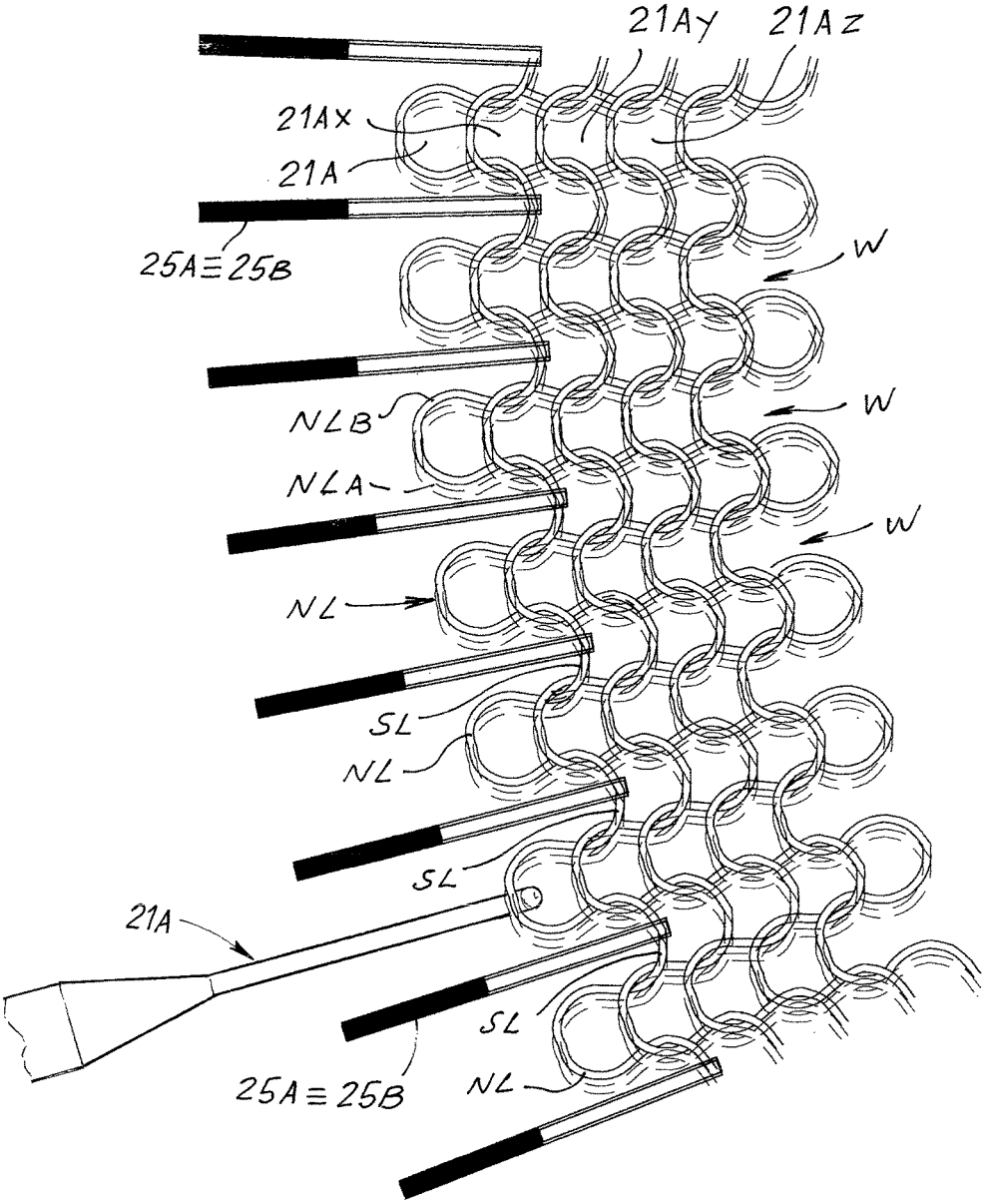
FIG. 36B shows a further enlargement of a different portion of FIG. 36, in an intermediate position along the semi-annular arrangement of pick-up hooks 25A, 25B.

FIG. 36B shows an enlargement of an intermediate portion of the superposed half-rings of pick-up hooks 25A, 25B shown in FIG. 36. The figure also schematically shows the two superposed edge portions and a schematic representation of the needle 21A of the linking machine 21. Different lines have been used to represent the loops or stitches of the two superposed edge portions. Reference numbers $NL_A$ and $NL_B$ denote superposed needle loops arranged between the same pair of pick-up hooks 25A, 25B, i.e. belonging to the two superposed edge portions of knitted fabric engaged by the oppositely arranged half-rings of pick-up hooks 25A, 25B. Reference numbers $SL_A$ and $SL_B$ designate superposed sinker loops arranged between adjacent pairs of pick-up hooks 25A, 25B and belonging to the two opposed edge portions of fabric. The last course of needle loops NL are shown as projecting beyond the sinker loops SL. It shall however be understood that in actual fact the yarn forming the last course of needle loops will retract against the pick-up hooks 25A, 25B.

Sewing or linking may be performed according to any known technique allowing a run-proof sewing or linking.

Figure 38:
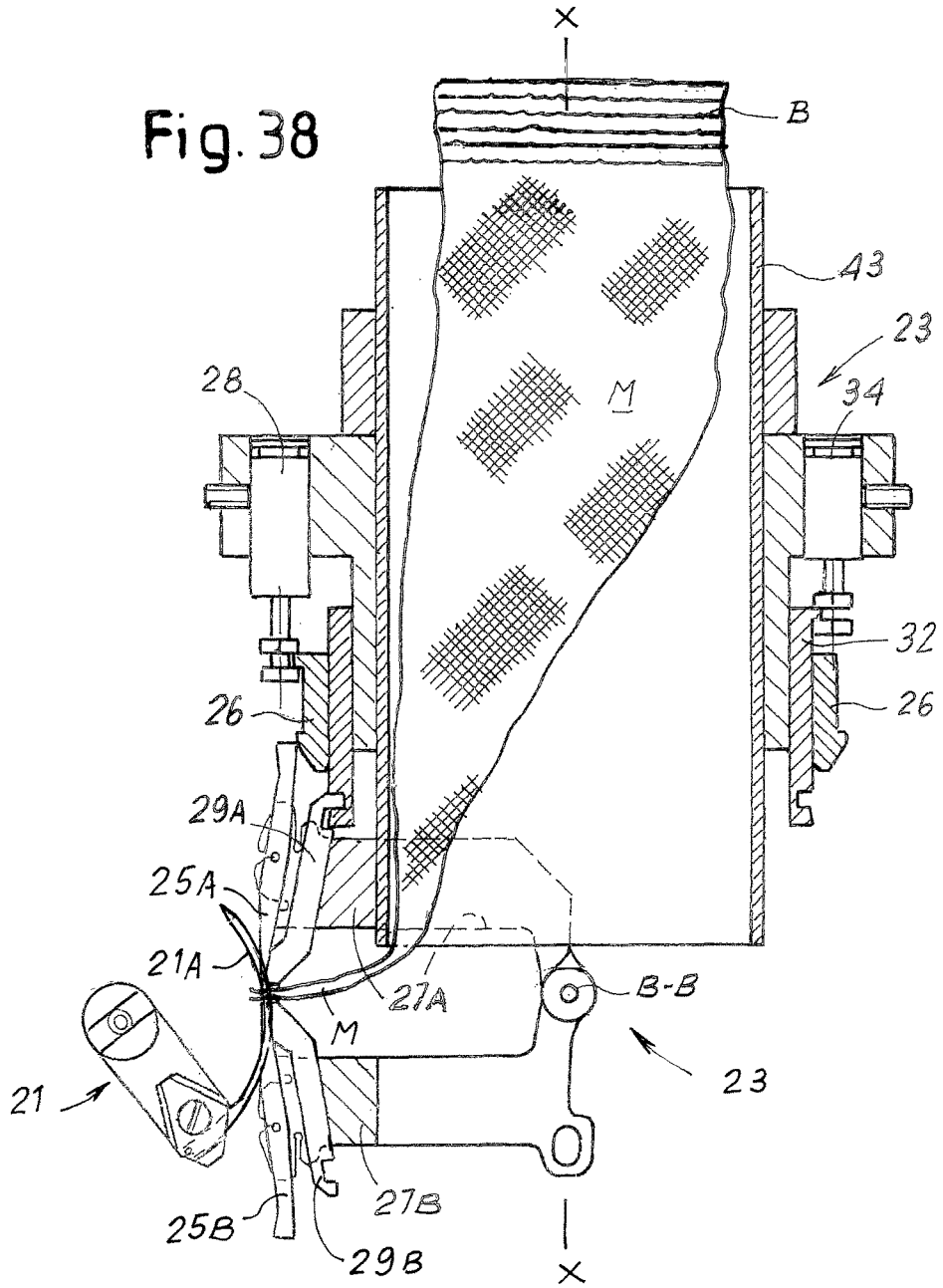
Figure 39:
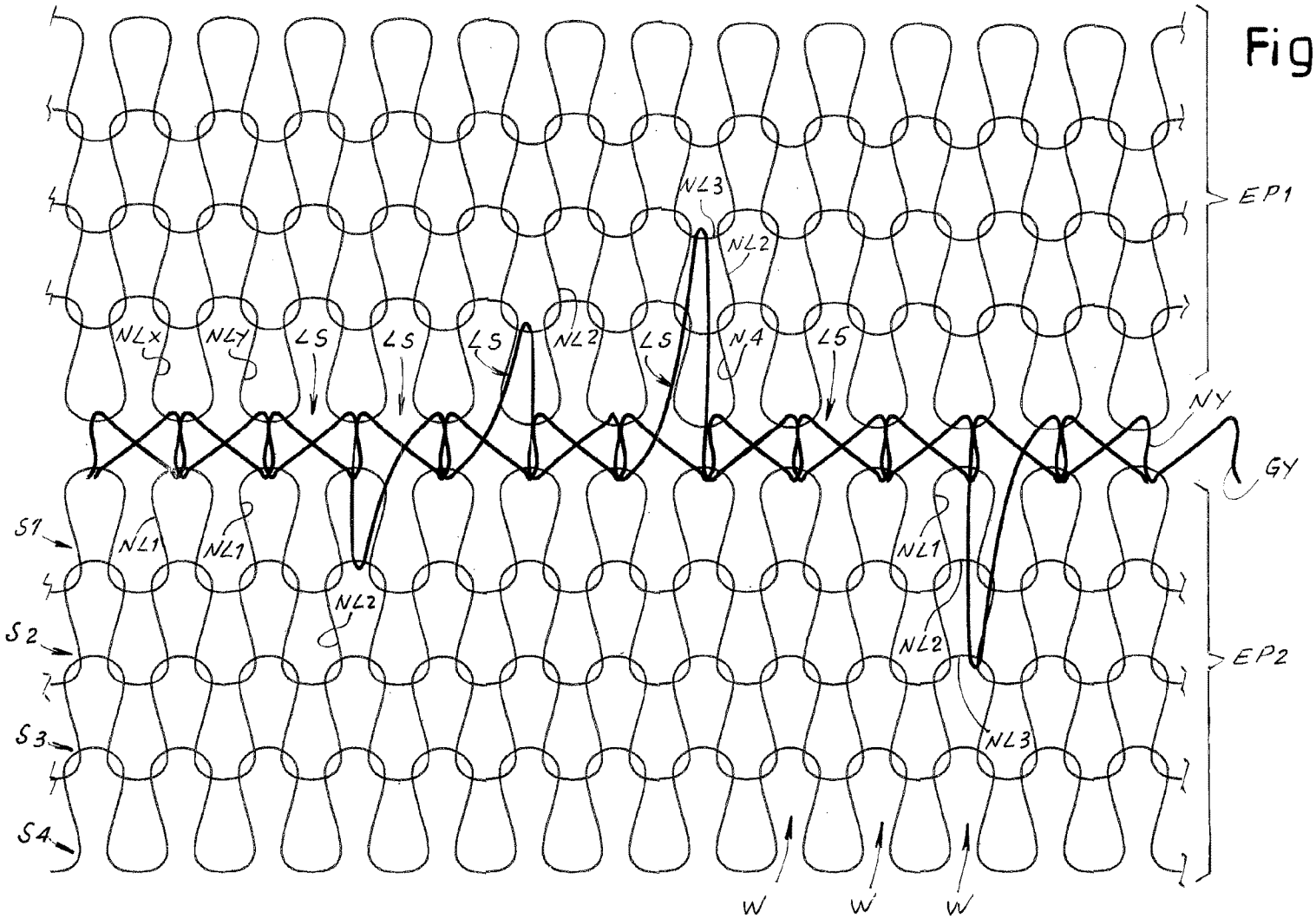
FIG. 39 shows a schematic enlarged representation of the linking stitches after closing of the toe.

For a better understanding of the linking or sewing operation, wherewith the toe is closed, reference can be made to FIGS. 36B, 38 and 39. The needle 21A of the linking or sewing machine 21 penetrates between each pair of adjacent superposed pick-up hooks 25A, 25B, as shown in the cross-sectional view of FIG. 38. The last needle loops $NL_A$ of one edge portion are located between respective pairs of adjacent pick-up hooks 25A, 25A. The last needle loops $NL_B$ of the other edge portion are located between corresponding adjacent pick-up hooks 25B, 25B.

The needle 21A of the linking or sewing machine 21 theoretically penetrates through the last needle loops $NL_A$, $NL_B$, as shown in FIG. 36B. In actual fact, however, since the knitted yarn refracts against the pick-up hooks 25A, 25B, rather than maintaining an extended position as shown in the schematic representation of FIG. 36B, the linking or sewing needle 21A can penetrate in the second last or third last or even fourth last needle loop NL, as shown at 21Ax, 21Ay, 21Az in FIG. 36B. Which needle loop NL is actually caught by the needle 21A can be actually undetermined. However, the linking or sewing stitches produced by the needle 21A are in any case formed in one of the last courses of stitches of the two edge portions. Moreover, they are formed in the needle-loop columns or wales W extending between adjacent pick-up hooks 25A, 25B.

FIG. 39 schematically illustrates a portion of the toe after final linking of two adjacent, mutually linked edge portions. Reference numbers GY and NY denote the crochet yarn and the needle yarn which form the linking stitches LS generated by the linking or sewing machine 21. The two edge portions are labeled EP1 and EP2. By way of example, FIG. 39 shows that some of the linking stitches engage the last needle loops NL1, but in some stitch wales W the linking yarns engage the second last needle loop NL2 or the third last needle loop NL3. Reference numbers S1, S2, S3, S4 denote the last, second from last, third from last and fourth from last course of stitches (and corresponding needle loops NL) of the knitted fabric forming the toe of the tubular knitted article M.

Therefore, when joining the first and second edge portions surrounding the toe of the tubular knitted article, the following steps are preformed:

- sinker loops of one of the last courses of stitches (e.g. one of the last, second last, third last and fourth last course) are retained by means of the pick-up hooks; and
- the needle loops of one of the last-formed courses of stitch of the first edge portion are joined to respective needle loops of the second edge portion between the pick-up hooks.

In preferred embodiments joining the first and second edge portions is performed by rotating the pick-up member and, while the pick-up member rotates, joining the first and second edge portions with linking stitches. While the linking stitches are formed, the sinker loops are sequentially released from the pick-up hooks of one of the two half-rings. The other of the two half-rings of pick-up hooks can still retain the respective sinker loops until the entire toe has been closed.

As mentioned above, in some embodiments, the method disclosed herein provides for making at least one last course of stitches of the tubular knitted article M run-proof. In this way, engaging by means of the pick-up hooks 25A, 25B loops, i.e. stitches inserted between the needles holding the last course and removing the last course from the circular bed the article is prevented from running Examples of methods, devices and techniques usable to produce a run-proof last course of stitches are known and can be used in the method of the present invention. Among them there are the methods and techniques described, just by way of non-limiting examples, in U.S. Pat. No. 3,046,768, U.S. Pat. No. 5,426,957, U.S. Pat. No. 5,115,650, U.S. Pat. No. 2,379,649, U.S. Pat. No. 3,430,462, U.S. Pat. No. 3,751,942, U.S. Pat. No. 3,470,715, U.S. Pat. No. 4,005,589. U.S. Pat. No. 5,992,182 discloses a particularly effective method usable in the method of the present invention. The content of the above mentioned patents is embodied in the present description.

In some embodiments, for better stabilizing the stitches of the last courses before overturning one half-ring of pick-up hooks over the other, it is possible to make one or more revolutions of the pick-up member with the half-rings of pick-up hooks in the co-planar arrangement, forming one or more rows or courses of sewing or linking stitches by means of machine 21 and needle 21A. The sewing or linking thread joins the last stitches of the tubular knitted article together, thus making them more stable. Then the two half-rings of pick-up hooks are overturned over one another and the loops or stitches of the two half-course are sewn or linked as described above.

In the description above different method have been illustrated to raise the article M once the last course MR has been formed, while it is still held by the needles 5 that have formed it, to allow the pick-up hooks 25A, 25B to pick-up stitches of the courses before the last course, that are between adjacent needles, i.e. at the sinker loops SL.

In FIGS. 37, 37A, and 38 a different method is shown for raising the last course MR of stitches. In this embodiment the rise is provided simply by raising the needles 5 of the circular needle bed. The stitches of the last course MR remain adhering to the stem and/or the needle latches (FIG. 37A) and are moved upwards by the needles due to the friction when they are removed from the tracks. The article M is therefore raised up to achieve an adequate position (FIG. 38) for be engaged by means of the pick-up hooks 25A, 25B.

Figure 40:
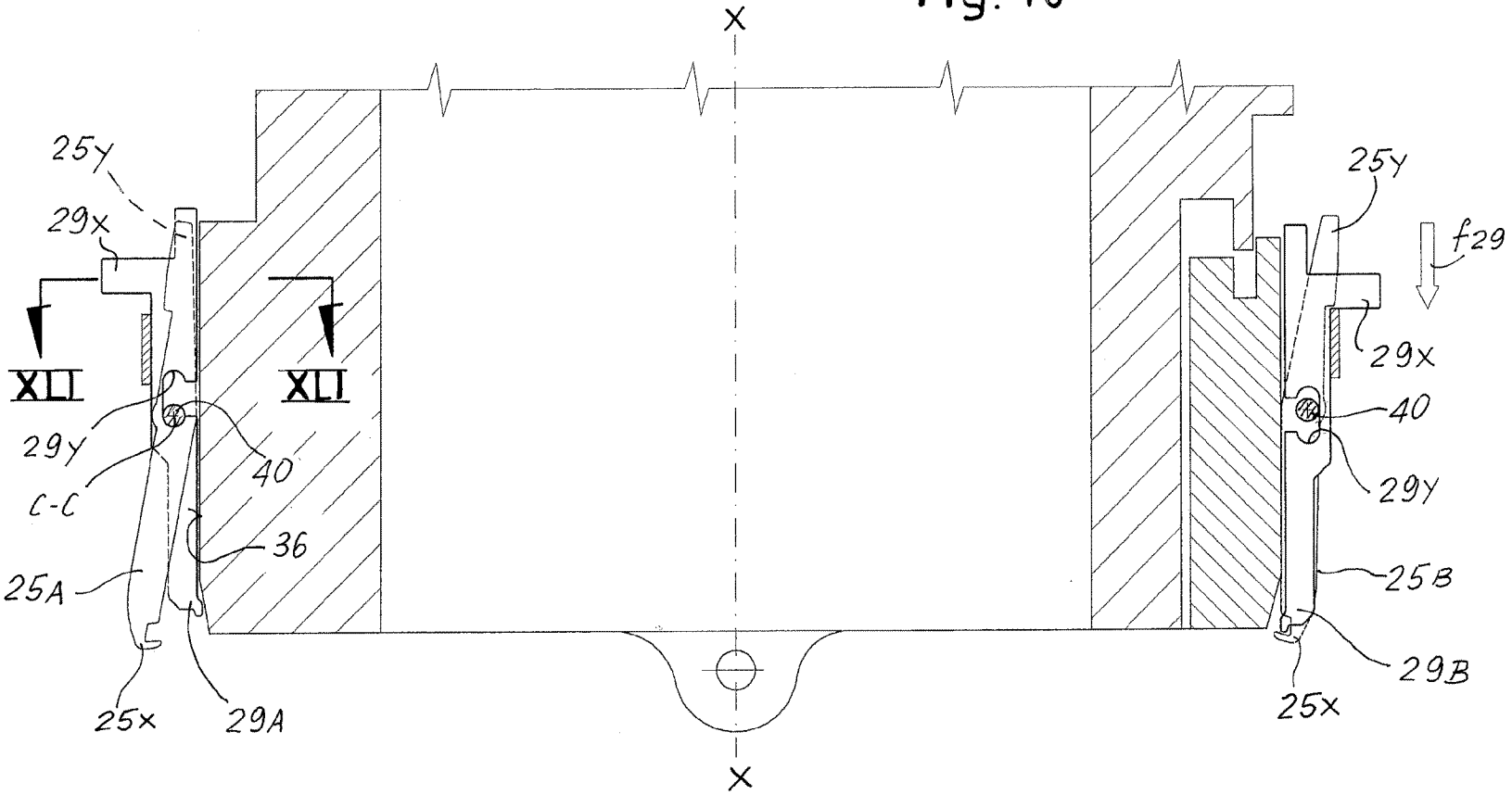
FIG. 40 shows a cross section a further embodiment of the pick-up member along a plane containing the axis thereof.
Figure 41:
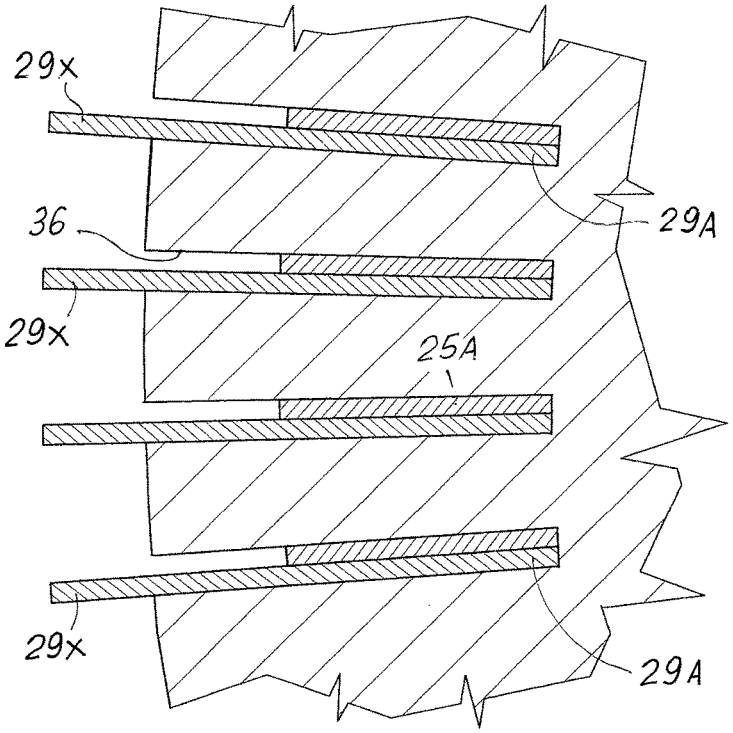
FIG. 41 shows a schematic cross section according to line XLI-XLI of FIG. 40.

FIGS. 40 and 41 schematically show a further embodiment of the pick-up hooks 25A, 25B and closure latches 29A, 29B, which can be provided on the pick-up member 23. The same reference numbers designate the same or corresponding parts, elements or components as in the previously described embodiments. In this embodiment each pair of pick-up hook 25A, 25B and relevant closure latch 29A, 29B are not co-planar, but rather arranged side-by-side, as can be best appreciated from the cross-sectional view of FIG. 41. In some embodiments each pair of pick-up hook and relevant closure latch can be housed in a respective slit 36 formed on the pick-up member 23, a circular arrangement of slits 36 being provided all around the axis X-X of pick-up member 23.

The pick-up hooks 25A, 25B can be provided with respective spikes or tips 25X at the active ends thereof, and with an abutment 25Y at the opposite end. The abutments 25Y co-act with actuating means configured and controlled for pivoting each pick-up hook 25A, 25B around their respective axis C-C.

In some embodiments each closure latch 29A, 29B is slidingly movable in the respective slit 36. The closure latches 29A, 29B can be provided with a translation movement according to arrow f29 in a direction generally parallel to the axis of symmetry X-X of the pick-up member 23. The movement of the closure latches 29 can be controlled by control means including one or more cams, as described herein above in connection with the embodiments of FIGS. 1-39. Each closure latch 29A, 29B can be provided with a respective butt 29X co-acting with the control cam for slidingly moving the closure latch 29A, 29B in the respective slit 36.

In some embodiments each closure latch 29A, 29B and respective pick-up hook 25A, 25B can be connected to the pick-up member 23 by means of a pin 40, the axis whereof forms the pivoting axis C-C of the pick-up hook 25A, 25B. Each closure latch 29A, 29B can be provided with a slot 29Y through which the pin 40 extends, the longitudinal dimension of the slot 29Y being such as to allow the closure latch 29A, 29B to slide according to arrow f29.

In FIG. 40 the pick-up hook 25A and relevant closure latch 29A are shown in the open position, i.e. in the position taken by said members before engaging the knitted fabric of the article to be removed from the needle cylinder 3. In the right hand side of FIG. 40, the pick-up hook 25B and relevant closure latch 29B are shown in the closed position, i.e. in the position taken when the knitted fabric (not shown) is engaged therebetween.

Figure 42:
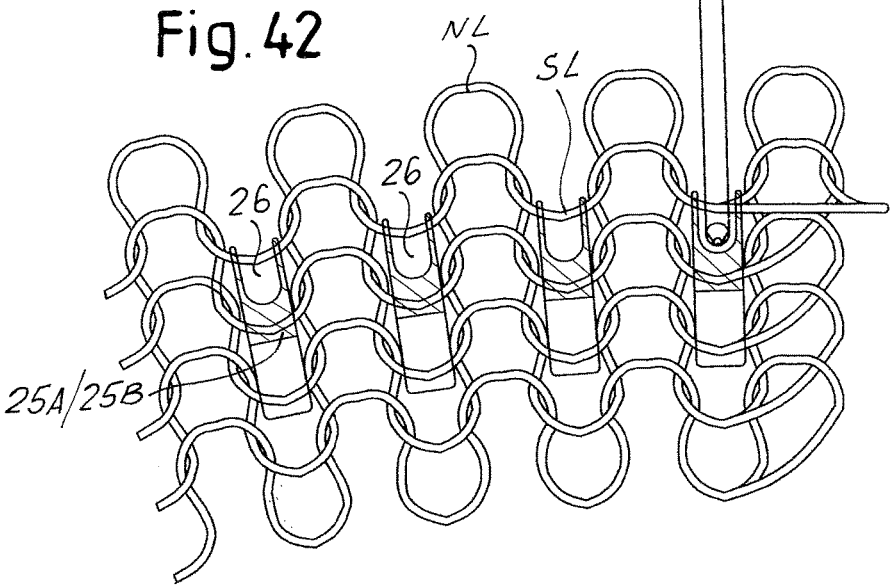
FIG. 42 shows a view similar to FIG. 36B in a further embodiment of the subject matter disclosed herein.
Figure 43:
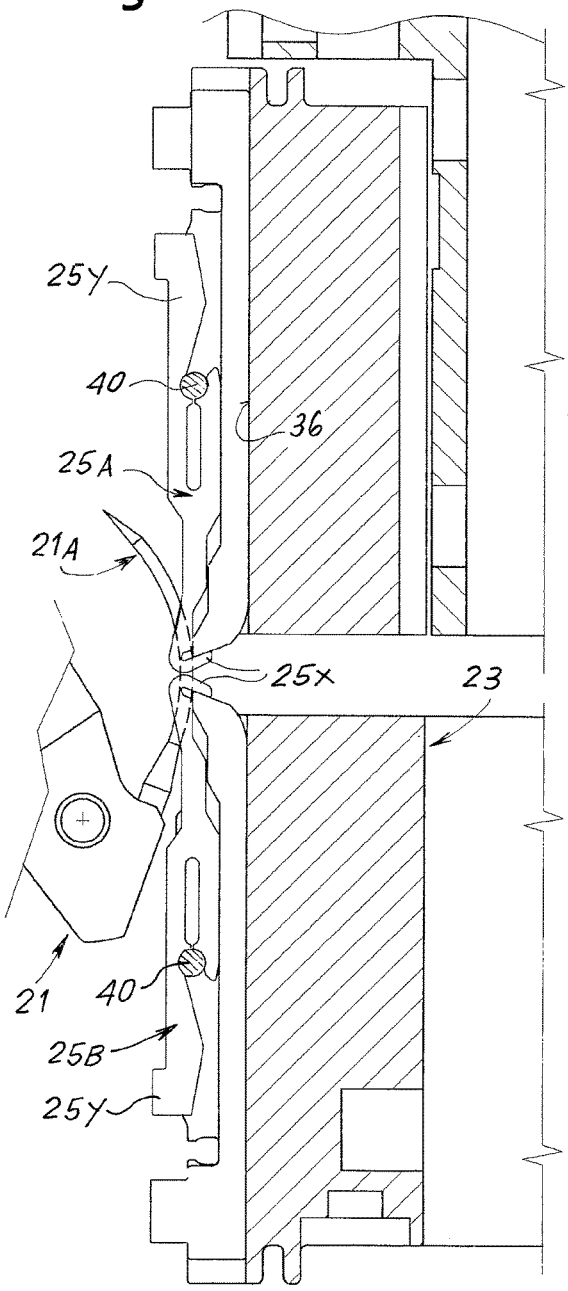
FIG. 43 shows a partial section of the pick-up member along a plane containing the axis of the pick-up member, according to the embodiment of FIG. 42.

FIGS. 42 to 45 illustrate a further embodiment of the invention. Corresponding, identical or equivalent parts or components are labeled with the same reference numbers as used in connection with the previously disclosed embodiments. FIG. 42 schematically illustrates pick-up hooks 25A, 25B engaging the two edge portions of a finished tubular article M. FIG. 43 illustrates a sectional view along a plane containing the axis X-X of pick-up member 43.

Figure 44:
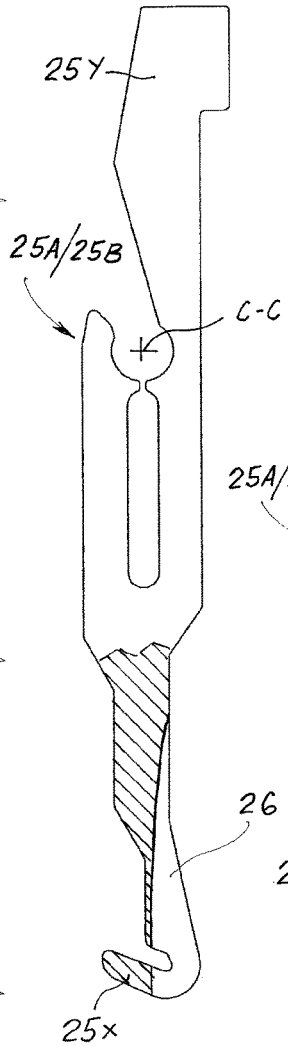
FIG. 44 shows a fragmentary section and side view of a pick-up hook of the pick-up member of FIG. 43, according to line XLIV-XLIV of FIG. 45.
Figure 45:
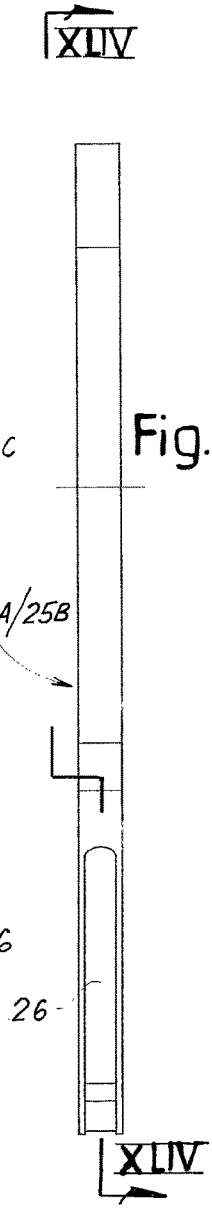
FIG. 45 shows a side view according to line XLV-XLV of FIG. 44.

FIGS. 44 and 45 illustrate enlarged views of a pick-up hook 25A, 25B of the pick-up member 43.

The main difference between the previously disclosed embodiments and the embodiment of FIGS. 42 to 45 relates to the shape of the pick-up hooks 25A, 25B. A further difference relates to the way in which the two edge portions are joined together.

Each pick-up hook 25A, 25B of this embodiment is provided with a slot or channel 26 on the side thereof opposite the respective spike 25X. As best shown in FIG. 43, when the two half-rings of pick-up hooks 25A, 25B are placed one on top of the other for linking the two portions of the toe edge, the linking needle 21A can enter the two adjoining channels or slots 26 of each pair of opposing pick-up hooks 25A, 25B. FIG. 42 illustrates the position of the linking needle 21A with respect to pick-up hooks 25A, 25B during linking. The linking stitches are thus formed at the sinker loops SL, rather than at the needle loops NL of the toe edge of the tubular article M. The link stitches can be located with a high degree of precision at the last-formed sinker loops SL, i.e. at the loops which connect pairs of adjacent last-formed stitches of the toe edge portions. A clean and neat linking is thus obtained.

All the embodiments disclosed herein provide for pick-up hooks which enter between adjacent needles of the circular needle bed in a circular knitting machine. They are configured and controlled so that each pick-up hook 25A, 25B engages generally a single loop of the knitted fabric, adjacent the last course of stitches, while the latter are still retained by the needles. The opposing half-rings of pick-up hooks are then turned one over the other and joining by linking or sewing can be performed directly on the pick-up hooks, e.g. by co-action of a linking needle 21A with the pick-up hooks.

A precise co-action of each pick-up hook with a corresponding needle is thus not required, contrary to the prior art. Possible small deformations, e.g. flexural deformations of the pick-up hooks and/or of the needles does not prejudice a correct operation of the pick-up member, while in prior art devices even the slightest misalignment between pick-up hook and needle would compromise the correct operation of the pick-up member or make it impossible altogether.

The embodiments disclosed herein are based on the surprising recognition that picking up the last formed stitch directly from the needles of the knitting machine is not essential for the correct removal of the knitted tubular article from the knitting machine. The embodiments disclosed herein are further based on the recognition that linking of loops can be performed directly on the pick-up hooks, even if the latter are engaging the last or one of the last-formed sinker loops, rather than the last formed needle stitch or needle loop.

Providing pick-up hooks which are pivotally mounted on the two opposing semi-circular supports 27A, 27B and providing a radially inwardly oriented movement of the pick-up hooks to penetrate between adjacent needles and engage the tubular fabric renders the pick-up member much simpler, more affordable, less expensive and more reliable than complex prior-art pick-up members, which were required to remove the last-formed stitches directly from the needle heads.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. Different features, structures and instrumentalities of the various embodiments can be differently combined.

The invention claimed is:

1. A method for producing a knitted tubular article on a circular knitting machine comprising a needle cylinder with a circular needle bed for knitting the tubular article, the method comprising the following steps:

providing a pick-up member, for picking-up the tubular article, the pick-up member comprising a plurality of pick-up hooks arranged according to a circular ring, each pick-up hook being provided with a respective active end, each pick-up hook being pivotally connected at a respective pivoting axis to a respective one of two semi-circular supports, which are hinged to one another around an axis and forming a first half-ring and a second half ring of pick-up hooks;

knitting a tubular article on the circular needle bed, starting from an elastic edge and ending with an open toe;

arranging the pick-up member coaxially with the needle cylinder, with the active ends of the pick-up hooks arranged around the needles of the needle cylinder and outside thereof;

while stitches of a last course of the knitted article are still held by said needles, engaging loops of the tubular article with the plurality of pick-up hooks by pivoting the pick-up hooks around respective pivoting axes of the pick-up hooks towards the circular needle bed and between pairs of consecutive needles of the needle cylinder, whereby one of the first half-ring and the second half-ring engages a first edge portion of an edge of the open toe and another of said first half-ring and the second half-ring engages a second edge portion of said edge of the open toe;

once the tubular article has been engaged by the pick-up hooks, unloading the stitches of the last course from the needles and removing the tubular article from the needle cylinder by means of the pick-up member;

overturning one of the first half-ring and the second half-ring onto the other of said first half-ring and said second half-ring, placing the first edge portion and the second edge portion onto one another;

while the tubular article is engaged by the pick-up member, joining the first edge portion and the second edge portion together to form a closed toe;

after closing the toe, unloading the tubular article from the pick-up member.

2. A method according to claim 1, wherein at least one pick-up hook is inserted between each pair of consecutive needles of the needle cylinder.

3. A method according to claim 1, wherein the first edge portion and the second edge portion are joined by linking.

4. A method according to claim 1, wherein the step of joining the first edge portion and the second edge portion further comprises the steps of:

retaining sinker loops of one of the last-formed stitch courses by means of said pick-up hooks; and joining needle loops of one of the last-formed stitch courses of the first edge portion to respective needle loops of the second edge portion between the pick-up hooks; or joining said sinker loops of one of the last-formed stitch courses of the first edge portion to respective sinker loops of the second edge portion.

5. A method according to claim 4, wherein the needle loops or the sinker loops are joined by linking stitches which engage needle loops or sinker loops belonging to one or more of the last five stitch courses, preferably one or more of the last four stitch courses, of the tubular knitted article.

6. A method according to claim 1, wherein the step of joining the first edge portion and the second edge portion further comprises the steps of:

rotating the pick-up member;

while rotating the pick-up member, joining the first edge portion and the second edge portion with linking stitches;

while forming the linking stitches, sequentially releasing the knitted article from the pick-up hooks of one of the first half-ring and the second half-ring, while retaining the knitted article on the other of said first half-ring and the second half-ring.

7. A method according to claim 1, wherein the pick-up hooks are controlled to move radially inwardly from an outside towards an axis of the needle cylinder of the circular knitting machine.

8. A method according claim 1, further comprising the step of retaining the stitches engaged by the pick-up hooks by means of closure latches before removing the stitches of the last course from the needles.

9. A method according to claim 1, further comprising the step of retaining the stitches engaged by the pick-up hooks by means of an elasticity of a yarn, whereof said stitches are made.

10. A method according to claim 1, further comprising the step of raising the tubular article from a loop formation plane to facilitate engagement of the tubular article by means of the pick-up hooks.

11. A method according to claim 1, wherein the tubular article is engaged by the pick-up hooks in correspondence at least of a second last or third last course of stitches.

12. A method according to claim 1, further comprising the steps of:

raising the needles engaging the stitches of the last course, before or after engaging the tubular article by means of the pick-up hooks;

lowering the needles and unloading the stitches of the last formed course, after having engaged the tubular article by means of the pick-up hooks.

13. A method according to claim 1, wherein, after having removed the tubular article from the needle cylinder, the tubular article is turned inside out before overturning the first half-ring and the second half-ring one over the other.

14. A method according to claim 1, wherein, after having formed the tubular article and before removing the tubular article from the needles of the knitting machine, at least one run-proof course is produced.

15. A system comprising:

a circular knitting machine comprising a needle cylinder with a plurality of needles forming a circular needle bed;

a pick-up member for engaging and removing a knitted tubular article from the circular needle bed, said pick-up member comprising a circular ring of pickup hooks, subdivided into first and second half-rings, each pick-up hook of one of said first and second half-rings being pivoted to a first semi-circular support and each pick-up hook of another of said first and second half-rings being pivoted to a second semi-circular support, the first semi-circular support and the second semi-circular support being hinged to one another such that the first and second half-rings can be arranged coplanar and can be overturned over one another;

a closing device, configured and arranged for co-acting with the pick-up member for closing a toe of the knitted article while the knitting article is retained on the pick-up member, wherein the knitting machine and the pick-up member are configured and controlled so that the pick-up member engages a final edge surrounding the open toe of a tubular article knitted by said knitting machine, by means of the pick-up hooks, when stitches of a last course of the tubular article are still engaged by the needles of the circular needle bed, wherein the pick-up hooks are configured for insertion between adjacent needles of the needle bed, the closing device and the pick-up member being configured and controlled so that the closing device joins opposed edge portions of the final edge of the knitted article retained by the pick-up hooks, with the first and second half-rings overturned one over the other.

16. A system according to claim 15, wherein the pick-up hooks are controlled so as to engage loops adjacent to the last course of stitches of the knitted article.

17. A system according to claim 15, wherein each pick-up hook is hinged to the respective semi-circular support around a respective pivoting axis, and wherein the pick-up hooks are configured and controlled so that when the pick-up member is arranged co-axial with the needle cylinder of the knitting machine the pick-up hooks are arranged with respective active pick-up ends around the needles of the needle cylinder and outside thereof, and engage the tubular article by moving the respective active ends towards the circular needle bed by pivoting around the respective pivoting axis.

18. A system according to claim 15, further comprising an arrangement for raising the stitches of the last course from a loop formation plane of the needle cylinder.

19. A system according to claim 15, wherein the pick-up member is associated with at least one actuator to control actuation of the pick-up hooks.

20. A system according to claim 15, wherein the pickup hooks are associated with closure latches to engage the stitches to said pick-up hooks.

21. A system according to claim 20, wherein the closure latches are provided with a closure translation movement generally parallel to an axis of the pick-up member.

22. A system according to claim 15, wherein the pick-up hooks are arranged so as to introduce at least one pick-up hook between each pair of consecutive needles of the circular needle bed.

23. A system according to claim 15, wherein the needles and the pick-up member are controlled so as: to engage by means of the pick-up hooks the tubular article in correspondence of or near the last-formed course of stitches; to remove the stitches of the last course from the needles, holding the tubular article by means of the pick-up hooks.

24. A system according to claim 15, further comprising a tubular element for turning inside out the tubular article engaged by the pick-up member.

25. A method for producing a tubular knitted article with a circular knitting machine comprising a needle cylinder with a circular needle bed for knitting the tubular article, the method comprising the steps of:

knitting the tubular article starting from an edge and ending with an open toe;

arranging a pick-up member for picking up the tubular article coaxially with the needle cylinder, said pick-up member being provided with a plurality of pick-up hooks arranged according to a circular ring subdivided into two circular half-rings that can be overturned over each other;

engaging the tubular article by means of said plurality of pick-up hooks while stitches of a last course of the knitted article are still retained by said needles, one of said two circular half-rings engaging a first edge portion of an edge of the open toe and another of said two circular half-rings engaging a second edge portion of the edge of the open toe;

unloading the stitches of the last course from the needles;

removing the tubular article from the needle cylinder by means of said pick-up member;

overturning one of said two circular half-rings of pick-up hooks onto the other of said two circular half-rings of pick-up hooks, placing one of said first edge portion and said second edge portion onto the other of said first edge portion and said second edge portion;

joining said first edge portion and said second edge together to form a closed toe;

after closing the toe, unloading the tubular article from the pick-up member.

26. A system comprising:

a circular knitting machine comprising a needle cylinder with a plurality of needles forming a circular needle bed;

a pick-up member for engaging and removing a knitted tubular article from the circular needle bed, said pick-up member comprising a circular ring of pickup hooks, subdivided into two half-rings that are provided with an overturning movement, for overturning the two half rings one over the other;

a closing device, configured and arranged for co-acting with said pick-up member for closing a toe of the knitted article while the knitting article is retained on the pick-up member, wherein said knitting machine and said pick-up member are configured and controlled so that said pick-up member engages a final edge surrounding the open toe of a tubular article knitted by said knitting machine, by means of said pick-up hooks, when stitches of a last course of said tubular article are still engaged by the needles of the needle cylinder, said pick-up hooks being configured for insertion between adjacent needles of the needle cylinder, wherein said closing device and said pick-up member are configured and controlled so that: the closing device joins opposed edge portions of the final edge of the knitted article when the opposed edge portions are retained by the half-rings of the pick-up hooks, the half-rings being overturned one over the other; and, after joining of the opposed edge portions, the tubular article is unloaded from the pick-up member.

27. A method according to claim 2, wherein the first edge portion and the second edge portion are joined by linking.

28. A method according to claim 2, wherein the step of joining the first and second edge portions further comprises the steps of:

retaining sinker loops of one of the last-formed stitch courses by means of said pick-up hooks; and joining needle loops of one of the last-formed stitch courses of the first edge portion to respective needle loops of the second edge portion between the pick-up hooks; or joining said sinker loops of one of the last-formed stitch courses of the first edge portion to respective sinker loops of the second edge portion.

29. A method according to claim 28, wherein the needle loops or the sinker loops are joined by linking stitches which engage needle loops or sinker loops belonging to one or more of the last five stitch courses, preferably one or more of the last four stitch courses, of the tubular knitted article.

30. A system according to claim 16, wherein each pick-up hook is hinged to the respective semi-circular support around a respective pivoting axis, and wherein the pick-up hooks are configured and controlled so that when the pick-up member is arranged co-axial with the needle cylinder of the knitting machine the pick-up hooks are arranged with respective active pick-up ends around the needles of the needle cylinder and outside thereof, and engage the tubular article by moving the respective active ends towards the circular needle bed by pivoting around the respective pivoting axis.

31. A system according to claim 16, further comprising an arrangement for raising the stitches of the last course from a loop formation plane of the needle cylinder.

32. A system according to claim 17, comprising an arrangement for raising the stitches of the last course from a loop formation plane of the needle cylinder.

* * * * *